US011719399B2

(12) United States Patent
Vogtner et al.

(10) Patent No.: US 11,719,399 B2
(45) **Date of Patent: *Aug. 8, 2023**

(54) WATERPROOF LAMP HAVING LENS WITH CONCENTRIC LIGHT MODIFYING PORTIONS

(71) Applicant: Custom Molded Products, LLC, Newnan, GA (US)

(72) Inventors: Zachary T. Vogtner, Fayetteville, GA (US); Victor L. Walker, Temecula, CA (US); Thomas R. Moore, Peachtree City, GA (US)

(73) Assignee: Custom Molded Products, LLC, Newnan, GA (US)

( * ) Notice: Subject to any disclaimer, the term of this patent is extended or adjusted under 35 U.S.C. 154(b) by 11 days.

This patent is subject to a terminal disclaimer.

(21) Appl. No.: 17/577,761

(22) Filed: Jan. 18, 2022

(65) Prior Publication Data

US 2022/0214020 A1 Jul. 7, 2022

Related U.S. Application Data

(63) Continuation-in-part of application No. 16/912,810, filed on Jun. 26, 2020, now Pat. No. 11,226,079.

(60) Provisional application No. 62/868,182, filed on Jun. 28, 2019.

(51) Int. Cl.

| | |
|---|---|
| ***F21V 13/02*** | (2006.01) |
| ***F21S 8/02*** | (2006.01) |
| ***F21V 3/06*** | (2018.01) |
| ***F21V 15/01*** | (2006.01) |
| *F21W 131/401* | (2006.01) |

(52) U.S. Cl.
CPC ..... *F21S 8/024* (2013.01); *F21V 3/0615* (2018.02); *F21V 3/0625* (2018.02); *F21V 15/01* (2013.01); *F21W 2131/401* (2013.01)

(58) Field of Classification Search
CPC . F21V 13/02; F21V 3/10; F21V 21/02; F21V 15/01
See application file for complete search history.

(56) References Cited

U.S. PATENT DOCUMENTS

| | | | | | |
|---|---|---|---|---|---|
| 1,918,480 | A | * | 7/1933 | Moore | H05B 39/105 315/136 |
| 2,333,931 | A | * | 11/1943 | Hendon | F21V 11/08 362/350 |
| 2,959,094 | A | | 11/1960 | Kosma | |
| 2,981,827 | A | * | 4/1961 | Orsatti | G02B 5/10 362/293 |
| 3,253,255 | A | | 5/1966 | Nagel | |
| 3,930,149 | A | * | 12/1975 | French | F21V 11/08 362/293 |
| 4,384,271 | A | * | 5/1983 | Visser | G08G 1/095 362/241 |
| 4,539,629 | A | | 9/1985 | Poppenheimer | |

(Continued)

*Primary Examiner* — Ismael Negron
(74) *Attorney, Agent, or Firm* — Laurence P. Colton; Smith Tempel Blaha LLC

(57) ABSTRACT

A light system having a hollow housing; a light source provided in the housing; means for mounting the housing to a pool wall or floor; and a lens provided at an open end of the housing, having at least a portion configured to modify at least a portion of the light to match, blend in with, or at least compliment the pool wall or floor; and a flange surrounding the periphery of the lens.

18 Claims, 31 Drawing Sheets

(56) References Cited

U.S. PATENT DOCUMENTS

| | | | | |
|---|---|---|---|---|
| 4,814,950 | A | 3/1989 | Nakata | |
| 5,367,349 | A | 11/1994 | Zeiler | |
| 5,842,771 | A * | 12/1998 | Thrasher | F21V 29/00 362/267 |
| 6,241,361 | B1 | 6/2001 | Thrasher | |
| 6,558,032 | B2 * | 5/2003 | Kondo | F21S 43/40 362/346 |
| 6,942,354 | B2 | 9/2005 | Metayer | |
| 6,986,594 | B2 * | 1/2006 | Wirth | F21S 43/40 362/335 |
| 7,070,310 | B2 * | 7/2006 | Pond | F21V 29/763 362/520 |
| 7,396,139 | B2 * | 7/2008 | Savage | F21V 5/04 362/267 |
| 7,520,628 | B1 * | 4/2009 | Sloan | F21V 29/85 362/373 |
| 7,722,216 | B2 | 5/2010 | Amor | |
| 8,529,102 | B2 * | 9/2013 | Pickard | F21K 9/233 362/348 |
| 10,125,967 | B2 | 11/2018 | Lockard | |
| 2015/0369469 | A1 * | 12/2015 | Vamberi | E01F 9/559 362/267 |
| 2019/0293266 | A1 | 9/2019 | Anderson | |

* cited by examiner

WATERPROOF LAMP HAVING LENS WITH CONCENTRIC LIGHT MODIFYING PORTIONS

CROSS REFERENCE TO RELATED APPLICATIONS

This patent application is a continuation-in-part of U.S. patent application Ser. No. 16/912,810 having a filing date of 26 Jun. 2020, which claims priority on and the benefit of U.S. Provisional Patent Application No. 62/868,182 having a filing date of 28 Jun. 2019.

BACKGROUND OF THE INVENTION

Technical Field

The present invention generally is in the field of lighting devices and methods for spas, swimming pools, hot tubs, garden baths, and the like. The present invention more particularly is in the field of lighting devices and methods for illuminating the interior of and/or the area surrounding spas, swimming pools, hot tubs, garden baths, and the like. The present invention more particularly also is generally directed to the formation or insertion of a lighting device into, or through, the side wall(s) defining the water-containing portion of a spa, swimming pool, hot tub, garden bath, or the like.

Prior Art

Few applications derive more benefit from the addition of aesthetically pleasing and/or safety lighting than artificial bodies of water such as spas, swimming pools, hot tubs, garden baths, and the like. Modern developments in the art make pool lighting a perfect feature for pool and spa manufacturers to focus on. Users and owners of such structures, therefore, often desire the addition of lighting features and methods of lighting such structures.

The addition of a lighting feature or the illumination of a feature already present on or features added to an artificial body of water, for example, can provide a substantial decorative effect to, or can provide a relaxing background visual experience for, or can provide for increased safety in or around an artificial body of water. As the market for spas, swimming pools, hot tubs, garden baths, and the like grows, users desire more, different, better, more interesting, and more aesthetically pleasing lighting features and methods of lighting.

Many existing spas, swimming pools, hot tubs, garden baths, and the like include some type of lighting feature to add to the aesthetics of the device. In some existing spas, swimming pools, hot tubs, garden baths, and the like, the lighting feature is located on a feature of the device, such as on a waterfall or water jet, for providing an aesthetically pleasing water flow. In other existing spas, swimming pools, hot tubs, garden baths, and the like, the lighting feature is located on the decking or the exterior of such structures or as separate lighting devices, such as lamps, for providing ambient lighting or safety lighting. In yet other existing spas, swimming pools, hot tubs, garden baths, and the like, the lighting feature is located within the tub of water, such as in the wall, shell, or liner, also for providing ambient lighting and safety lighting.

In the pool and spa market, aesthetics are becoming more and more important. Aligned with this trend, high-end pool finishes are becoming more popular, and there are many to choose from. Some even have pebbles, stone, or glass beads mixed in with the plaster. When these aggregate materials are mixed with the plaster it creates a multi-tone finish that is not easily matched by a single-color component. Likewise, advancements in the printing and manufacturing of vinyl liners have led to the introduction of more intricate and ornate and sophisticated patterns and textures available for vinyl liner pools. Similar advancements in fiberglass technology have increased the aesthetic options for the shells of fiberglass pools. There is demand for pool components and equipment that compliment rather than stand out against these finishes. There is demand for components and equipment that are essentially invisible when installed so as not to detract from the overall aesthetic. Some components have been made to incorporate the pool finish into the component to help them blend in with the surroundings. However, there is not a similar solution available for pool and spa lights. Lights currently on the market have polished metal or color plastic trim to accent the feature in the pool. There is a need for a pool light that can be adapted to incorporate these high-end finishes into the light fixture to become invisible when the light is not on. Alternatively, there is a need for a new and unique lighting effect when the light is on.

Some reasons why pool and spa lighting features have remained relatively unadorned are the challenges to overcome to arrive at the present invention. For example, lights create heat, which causes thermal expansion and contraction of materials, each at a different rate, which can create challenges when adhering different materials to one another, especially plaster and concrete. For another example, light lenses have been traditionally made of glass, which poses challenges when attempting to fasten another material to it. For yet another example, in pool/spa lighting typically "brighter is better" and it is counterintuitive to block or mask a center portion, or indeed any portion, of the lens. For still another example, although there have been many advancements in the electrical design of lighting over recent years, the way in which lighting features are installed into and interact with the pool or spa, such as in a niche, has remained effectively unchanged for decades.

Currently, known wet-niche lights are intended for installation in pools or spas with floors and walls formed of gunite or concrete (shotcrete) with a reinforcing bar (rebar) frame. The outside shape of the pool or spa is formed from a suitable material and in some cases, the excavated dirt wall will serve as the outside form. The shape of the inside wall of the pool or spa is skeletally formed from rebar that is bent to the desired shape. Niches, often as a metal or plastic form, are positioned between adjacent rebars such that the niche is held on preferably all four sides by sections of rebar. Once the niche has been securely positioned (wedged) in the rebar it must be securely tied to the rebar with tie wire. When the concrete or gunite is poured or shot to form the pool or spa wall, the niche remains as an indentation-like feature in the pool or spa wall. A hole or passageway can be formed in the back of the niche to allow wiring from outside of the pool or spa structure to extend into the niche for energizing a lighting feature.

The pool or spa must meet the requirements of the current National Electrical Code and all local codes and ordinances for a lighting feature to be properly installed. For example, for a wet niche below the surface of the water for containing an underwater light the lighting circuit must have a ground fault circuit interrupter (GFCI) for line voltage 120-volt models, and must have an appropriately rated circuit breaker. The junction box (or, for 12-volt models, the low voltage transformer) must be located at least eight inches above water level, at least four inches above ground level, and at least four feet from the edge of the pool or spa. The light fixture and all metal items within five feet of the pool or spa must be properly electrically bonded to a reliable point of grounding. The wet niche must be properly installed so that the top edge of the underwater light's lens is at least eighteen inches below the surface of the water in the pool or spa.

For vinyl lined metal wall, fiberglass panel, or fiberglass pools, a niche box can be installed by drilling and cutting out wall panel sections, inserting the niche box through the panel section from the interior of pool, and securing the niche box to the pool wall. For wood or fiber panel vinyl liner pools, a similar process can be carried out by cutting out a portion of the wall panel, inserting a niche box through the hole in the panel from interior of pool, and securing the niche box to the pool wall. However, once the lighting feature is inserted into the niche box, one typically is left with a common, aesthetically neutral lens. Thus, for this type of pool or spa, it would be advantageous to adorn the lens in a manner that blends with, contrasts with, or compliments the liner pattern.

There is, accordingly, a need for new and different lighting devices and methods for illuminating the interior of and/or the area surrounding spas, swimming pools, hot tubs, garden baths, and the like, and for lighting devices and methods for generating aesthetically pleasing light in, on, and around spas, swimming pools, hot tubs, garden baths, and the like. There also is a need for new and different lighting feature and methods of lighting artificial bodies of water and the like. There also is a need for an efficient and effective pool light that is minimalist in dimensions and materials, without sacrificing function, that also is aesthetically pleasing and can be well hidden or camouflaged, and that has different aesthetic designs and shapes, to maximize the lighting function as well as other forward-looking functions. It is to these needs and others that the present invention is directed.

BRIEF SUMMARY OF THE INVENTION

One exemplary embodiment of a spa light system of the present teachings is a flanged embodiment comprising a base component having a body, a lens at a first end of the body, and a means for securing the base component to surrounding mounting surface, a decorative flange, and a light source. The body can be any shape, such as cylindrical, triangular, square, pentagonal, etc. in cross-section, as desired for aesthetic purposes. Similarly, the lens can be any shape, such as flat, domed, wavy, ridged, faceted, etc. as desired for aesthetic purposes. The body can be structured for mounting on or through a shell wall, within niches in a solid wall, or in passages in a shell or solid wall. The mounting structure can comprise threads and nuts, tongues or tabs and slot or screw holes, weldments, etc. depending on the structure to which the invention is to be mounted.

Another exemplary embodiment of a spa light system of the present teachings is a flangeless embodiment comprising a base component having a body, a lens at a first end of the body, and a means for securing the base component to surrounding mounting surface, and a light source. The body also can be any shape, such as cylindrical, triangular, square, pentagonal, etc. in cross-section, as desired for aesthetic purposes. Similarly, the lens also can be any shape, such as flat, domed, wavy, ridged, faceted, etc. as desired for aesthetic purposes. The body also can be structured for mounting on or through a shell wall, within niches in a solid wall, or in passages in a shell or solid wall. The mounting structure also can comprise threads and nuts, tongues or tabs and slot or screw holes, weldments, etc. depending on the structure to which the invention is to be mounted.

In these exemplary embodiments, the lens is a translucent lens defining a desired shape with a recessed central region, and a translucent region as a concentric band around the recessed central region. In the flanged embodiments, the decorative flange can be a concentric band around the translucent region. The decorative flange can be a part of the lens, can be a part of the body component, can be a separate component as a band around the lens, or can be a part of a separate housing for holding the lens. The flange also can be or have a recessed region.

In both the flanged and the flangeless embodiments, the recessed central region of the lens can be filled with a material to match or contrast with the pool or spa wall or shell, or the central recessed region of the lens can retain a cap having a desired design or pattern, including holes or punch-outs therethrough, or various other aesthetic devices. In this manner, the light emitted from the light source through the lens can be altered, patterned, or otherwise aesthetically changed. In the flanged embodiments, the recessed region of the flange also can be filled with a material to match or contrast with the pool or spa wall or shell.

Another exemplary embodiment of both the flanged and the flangeless embodiments comprises a lens mechanically retained by and/or in a pool niche. These embodiments of the light system preferably can be mounted in or to a niche or niche box that is embedded into the pool or spa wall. In these embodiments, the light system of the present invention can be installed during the initial construction of the pool or spa or as a retrofit into a preexisting niche or passage in or through the pool or spa wall. Similarly, all embodiments of the spa light system of the present invention can be installed through a pool or spa shell or liner as a unitary item secured to the shell or liner or in a separate light housing separately secured to the shell or liner.

These features, and other features and advantages of the present invention will become more apparent to those of ordinary skill in the relevant art when the following detailed description of the preferred embodiments is read in conjunction with the appended drawings in which like reference numerals represent like components throughout the several views.

BRIEF DESCRIPTION OF THE DRAWINGS

In the figures, like reference numerals refer to like parts throughout the various views unless otherwise indicated. For reference numerals with letter character designations such as "102A" or "102B", the letter character designations may differentiate two like parts or elements present in the same figure. Letter character designations for reference numerals may be omitted when it is intended that a reference numeral to encompass all parts having the same reference numeral in all figures.

DETAILED DESCRIPTION OF PREFERRED EMBODIMENTS

Generally—

Figure 1:
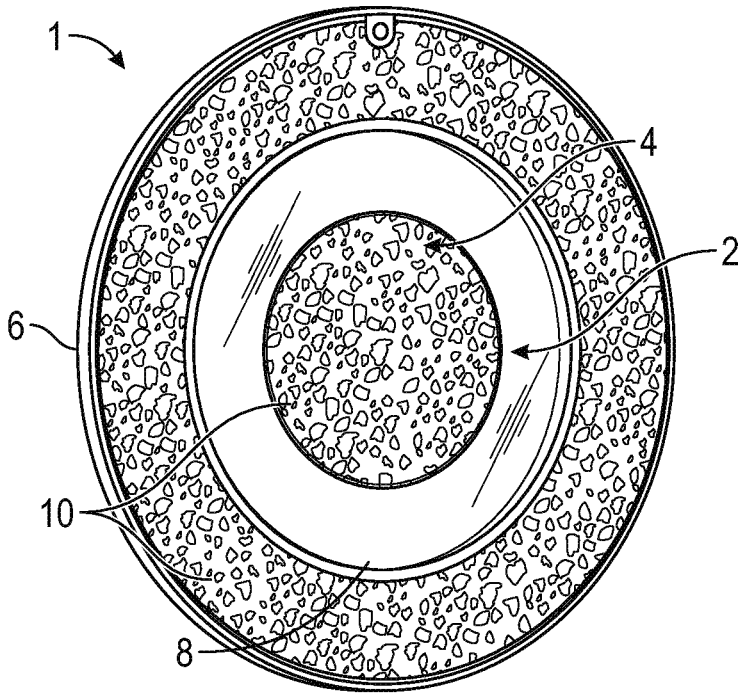
FIG. 1 is a front perspective view of an exemplary embodiment of a flanged light system according to the present invention.

Embodiments and aspects of the present invention provide lighting devices and methods for illuminating the interior of, and/or the area surrounding spas, swimming pools, hot tubs, garden baths, and the like, that are not susceptible to the limitations and deficiencies of the prior art. The inventive concepts described herein, in certain non-limiting embodiments, allow for the formation or insertion or engagement of a lighting device into a pool or spa wall such that the lighting system/device provides functional illumination, and such that the non-illuminating portion of the lighting device is efficiently and effectively hidden from a user's view, or from contact with a user or pool equipment (e.g., a pool skimmer, a pool robots). More specifically, the lighting devices disclosed herein can be secured within niches or passages formed in the solid walls of in-ground pools and spas, secured within niche boxes secured to pool or spa shells or liners, or secured directly to a pool or spa shell or liner.

In preferred embodiments, the inventive concepts described herein allow for inserting, embedding, recessing, insetting, engaging, in certain non-limiting embodiments, a lighting device into, or through, the side wall(s) and/or floor defining the water-containing portion of an artificial body of water. The inventive concepts described herein also allow for a recessed, inset, and/or friction-fit grommet lighting device. The inventive concepts described herein also allow for a lighting device that is efficient and effective, that is minimalist in dimensions and materials, without sacrificing function, but that also is aesthetically pleasing and can be well hidden or camouflaged, and that facilitates different aesthetic designs and shapes, to maximize the lighting function, and to facilitate other parallel- or related-functions, such as creating synchronized lighting. This allows for a streamlining and simplifying alongside an expansion of the types of systems/devices capable of solving the problems inherent in the prior art.

As context and further background, one example of a light system generally is known for placement on or through a spa shell on the tub interior, either above, at, or below the water line of the water in the spa tub, so as to provide light or illumination for the interior of the spa tub. In this example, the spa light comprises a structured or molded base component having a hollow body that is mounted through the spa shell, a lens or light diffuser at a first end of the body, a nut or a friction fit wall grommet, or the like, for securing the base component on the spa shell, and a light source. Optionally, the spa light comprises a separate cap or is structured and shaped with a cap to partially cover the light source in the spa light, allowing the light to be directed. Also optionally, the spa light comprises a decorative cap having a decorative design thereon. This example also could be used on a pool or spa constructed with a vinyl liner or with a fiberglass wall.

Thus, as a general example, the inventive light system comprises a base component having a hollow body or interior, a front end, and a back end; a lens located at the front end of the body, the lens comprising a central area or portion and a peripheral area or portion surrounding the central area or portion; an optional flange surrounding the peripheral area or portion; a means for mounting or attaching the light system to a mounting surface or an attachment location; a light source contained within the base component, wherein at least a portion of the light emanating from the light source passes into the lens; and a means for interfering with or affecting the light emanating from the light source so as to prevent or alter a portion of the light from entering or passing through at least the central area or portion of the lens.

In another example, the light comprises a structured or molded base component having a hollow body that is mounted in a pool or spa wall, typically in a niche or passage in or through a solid wall such as gunite or concrete, a lens or light diffuser at a first end of the body, a tongue or tab for securing the base component on the wall or to the niche or niche box, a screw hole for accommodating a screw or other attachment means for further securing the base component on the wall or to the niche or niche box; and a light source. Optionally, the light comprises a separate cap or is structured and shaped with a cap to partially cover the light source in the light, allowing the light to be directed. Also optionally, the light comprises a decorative cap having a decorative design thereon.

The base component preferably comprises a one piece, generally hollow cup-like component having a closed or substantially closed bottom or back end, side walls, and an open top or front end, and may be formed at least partially out of a transparent, semi-transparent, or translucent material capable of transmitting light. The lens component is attached to the open top or front end of the base component normal to the axis of this generally hollow component. The open top or front end allows access to the generally hollow interior of the base component, for containing and accessing the light source.

The general structure of the lens component or the components making up the lens is a common feature of all of the light systems of the present invention, irrespective of the type of pool or spa, and irrespective of the type of mount. The lens component, or light diffuser, allows the transmission of light from the light source to the tub interior of the spa. The lens component, or the components making up the lens component, comprises a translucent portion defining a desired shape with a recessed central region, a translucent region as a concentric band around the recessed central region, and an optional flange as a concentric band around the translucent region. The optional flange can be a part of the lens, can be part of the body or housing, can be a separate component as a band around the lens, or can be a part of a separate housing for holding the lens. The optional flange also can be or have a recessed region.

The recessed central region of the lens and/or the recessed region of the optional flange can be filled with a material to match or contrast with the pool or spa wall or shell, or the central recessed region of the lens can retain a cap having a desired design or pattern, including holes or punch-outs therethrough, or various other aesthetic devices. In this manner, the light emitted from the light source through the lens can be altered, patterned, or otherwise aesthetically changed. The lens or light diffuser may be a permanent portion of the body or base component, being molded at the same time as the body or base component. The lens and body are preferably in a watertight arrangement to protect the light source and electronics from water ingress. Further, the body may be potted (filled with epoxy, RTV, silicone sealant, etc.) for further protection. The light source may be an LED, a mini-bulb, or a more conventional or older bulb. The light source preferably is removable and replaceable.

The device may further comprise a tubular structure for holding the light source, such as a light emitting diode (LED) or other light-emitting device, depending on the embodiment of the invention use, which generally is dependent on the type of mount, namely, in-wall, in-niche, in-passage, or through-shell. The tubular structure can be an extension of the body and is generally coaxial with the body, whereby the hollow interior extends through the body and the tubular structure. The tubular structure is structured to contain the light source. As disclosed previously, the light source itself can be any light source suitable for use in a body of water, including, for example purposes only, one or more LEDs, one or more LED arrays, one or more LEDs mounted on one or more printed circuit boards (PCBs). The light source also can be designed to provide aesthetically pleasing light. The tubular structure allows for light emanating from the light source to be directed at the lens or light diffuser, generally centrally, such that the lens or light diffuser can be illuminated, and the illumination to be seen from the tub interior of the spa. Preferably, the optional cap will block a portion of the light illuminating the lens or light diffuser from being seen by the user. Optionally, the light source can be arranged in a ring or other pattern such that at least a portion of the light can escape through an area of the lens outside of the blocked center portion.

The lights are 12V AC but also may be provided in other electrical arrangements such as 120V AC, 24V AC, 24V DC, 12V DC. The lights can be color-changing LEDs, but also may be white-only LEDs or incandescent lights. In LED embodiments, the lights are RGB and designed to sync with other lighting or lighted water features. In other embodiments, the lights may have a quick-disconnect feature to allow for a power cord to be removed from the light for easy service/replacement (cords typically are 50-100 ft long or more in the field, and have to be run through conduit to remove the cable and install a replacement).

In use on a pool or spa wall of the shell or liner type, the light may be attached to the wall at the manufacturing location, at the installation location, or after the pool or spa has been installed. In an exemplary embodiment, the base component is attached to the wall by drilling a hole through the wall, inserting the bottom or back end of the base component through the hole from the interior or wet/water side of the pool or spa such that the rear side of a mounting support of or proximal to the lens or light diffuser contacts the interior surface of the wall, screwing a nut onto the screw thread on the exterior of the body, and tightening the nut up against the exterior dry side surface of the of the wall such that the wall is sandwiched between the nut and the rear side of the mounting support and/or at least one gasket. The lens component then can be secured to the base component. In use on a solid pool or spa wall, such as an inground pool or spa with a gunite or concrete wall, the light may be inserted into a niche or passage in the wall, which niche or passage can be pre-existing or created specifically for the light. Inground pools and spas typically are made on-site and with niches or passages through their wall for mounting lights and other features. These pre-existing niches or passages typically are a standard size, and the present inventive light device can be made to be of such standard size for easy mounting in such pre-existing niches or passages.

Specific Exemplary Embodiments

With the above context in mind, a first exemplary embodiment of the inventive concepts provides an efficient, effective, and versatile light system for connecting to the controller and power-supply system of a pool or spa, wherein the light system comprises a lens component with at least a portion of the lens configured for receiving a "masking", "hiding", filler, or bonding material, whereby the light system attractively blends in with or compliments the pool wall(s) or floor. The light system is configured for inserting, embedding, recessing, and insetting into, or through, the side wall(s) or floor defining the water-containing portion of the pool or spa, and the light system is efficiently and effectively obscured or otherwise provided with an aesthetic feature, and allowing for a generally reduced level of contact with a user or pool equipment by having a thin profile.

A second exemplary embodiment of the inventive concepts provides a light system comprising a lens, with at least a portion of the lens configured for receiving a "masking", "hiding", filler, or bonding material, and with a decorative flange that bounds the perimeter of the lens. The decorative flange along the exterior and the "masked" or "hid" interior portion sandwich a translucent portion of the lens. The lens can be of any shape, including planar and domed, and circular or other geometrical shapes.

A third exemplary embodiment of the inventive concepts provides a light system comprising a Fresnel lens, with at least a concentric portion of the lens configured to receive a "masking", "hiding", filler, or bonding material. Alternatively, the lens can have a prismatic or other pattern rather than a standard Fresnel pattern, depending on the desired lighting effect. The central interior portion of the lens can be filled in the field by the pool builder with plaster, Pebble-Tec™ aggregate finish, concrete, gunite, tile, fiberglass, acrylic, vinyl, etc. to match or compliment the surrounding mounting surface around the lens, namely the pool or spa wall, shell, or liner. The concentric portion of the lens may contain ribs, barbs, anchors, or other features to help mechanically fasten or facilitate fastening of the "masking" or "hiding" material. Alternatively, an adhesive or various types of welding can be used to fasten the material within the central interior portion. The lens may be made in clear (glass or plastic) or with a translucent effect (etched glass or diffused clear plastic). The lens also may comprise features or patterns such as prisms, dimples, bumps, ribs, ridges, etc. to enhance, focus, diffuse, or direct the light to achieve a variety of lighting effects as the light passes through the lens. This third exemplary embodiment can be flangeless or can comprise a concentric decorative flange that bounds the perimeter of the lens. The optional decorative flange is located circumferentially about the exterior of the lens and also can be filled in the field by the pool builder with plaster, Pebble-Tec™ aggregate finish, concrete, gunite, tile, fiberglass, acrylic, vinyl, etc. to match or compliment the surrounding mounting surface around the lens, namely the pool or spa wall, shell, or liner.

A fourth exemplary embodiment of the inventive concepts provides a flanged light system comprising a lens, with at least a concentric portion of the lens configured to receive a "masking", "hiding", filler, or bonding material, and with a concentric decorative flange that bounds the perimeter of the lens. The decorative flange itself can have at least a concentric portion configured to receive a "masking", "hiding", filler, or bonding material. At least the concentric portion of the decorative flange, along the exterior, and the concentric interior portion of the lens, sandwich a concentric translucent ring/halo/band of the lens. The concentric portion of the lens and the flange may be filled in the field by the pool builder with plaster, Pebble-Tec™ aggregate finish, concrete, gunite, tile, fiberglass, acrylic, vinyl, etc. to match or compliment the surrounding mounting surface around the lens. The concentric portion of the lens and the flange may be filled by the manufacturer with a separate cap or insert made of stainless steel, color coordinated plastic, or any other decorative material. The concentric recessed portions of the lens and the flange may be simple recesses. The concentric recessed portions of the lens and the flange may be concave, flat, or convex, but a preferred embodiment is concave. Material installed into the recess may be fashioned to be concave, flat, or convex.

A fifth exemplary embodiment of the inventive concepts provides a flangeless light system comprising a lens, with at least a concentric portion of the lens configured to receive a "masking", "hiding", filler, or bonding material. The concentric portion of the lens may be filled in the field by the pool builder with plaster, Pebble-Tec™ aggregate finish, concrete, gunite, tile, fiberglass, acrylic, vinyl, etc. to match or compliment the surrounding mounting surface around the lens. The concentric portion of the lens may be filled by the manufacturer with a separate cap or insert made of stainless steel, color coordinated plastic, or any other decorative material. The concentric recessed portions of the lens may be simple recesses. The concentric recessed portions of the lens may be concave, flat, or convex, but a preferred embodiment is concave. Material installed into the recess may be fashioned to be concave, flat, or convex.

Flanged Embodiments

FIG. 1 is a perspective view of an exemplary embodiment of a flanged light system 1 of the present invention. The light system 1 comprises a base component (not shown) having a tubular body (not shown) for mounting through or within a surrounding mounting surface 16 (a pool or spa shell, floor, liner, or wall, for example) (best seen in FIGS. 3, 5, 7, and 9), a generally flattened lens 2 at a first end 12 of the body, a mounting means (not shown) for securing the base component to surrounding mounting surface 16, a decorative flange 6, and a light source(s) (not shown).

This embodiment of the base component is a one-piece component. The base component has the lens 2 attached normal to the first open end 12 of the tubular body (best seen in FIG. 2). The first open end of the tubular body (not shown) preferably is open, allowing access to the hollow interior of the base component, for containing and accessing the light source(s). The lens 2 is formed out of a transparent, semi-transparent, or translucent material capable of transmitting light, and defines at least a central region 4 configured for receiving a "masking", "hiding", filler, or bonding material 10 and a visible region 8 that allows light to pass through the lens 2 and be seen. The decorative flange 6 bounds the outermost circumference or perimeter of the lens 2. The decorative flange 6 and the central region 4 of the lens 2 sandwich the visible region 8 of the lens 2 to effectively form a translucent ring/halo/band to be illuminated by the light source(s). The decorative flange 6 also is configured to have a recess 14 to receive a "masking", "hiding", filler, or bonding material 10 that is the same or different from the central region 4.

Figure 11:
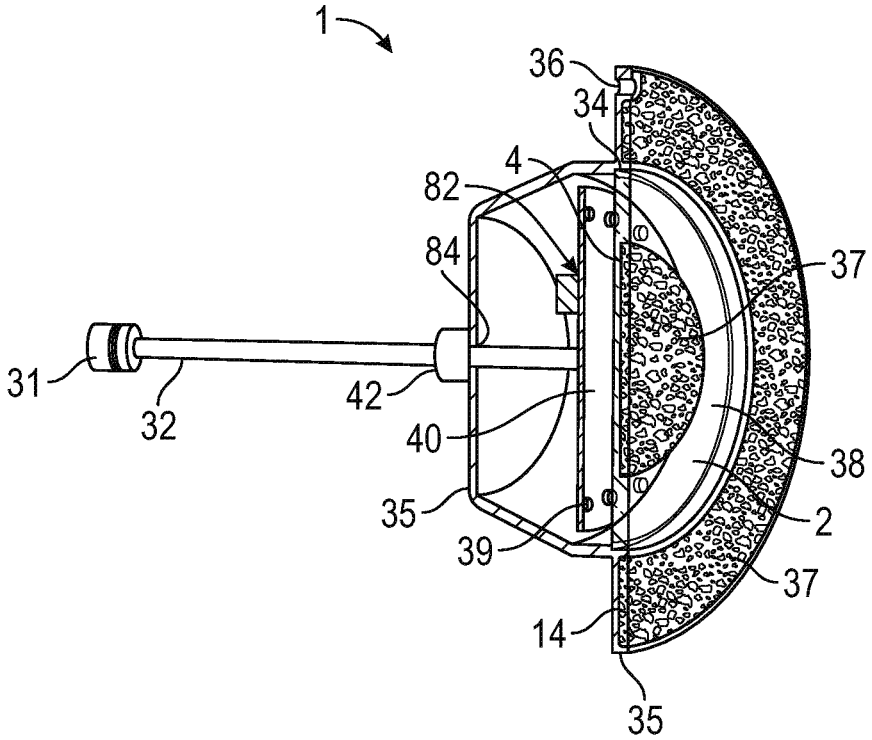
FIG. 11 is a perspective side sectional view of the flanged light system of FIG. 10.

The lens 2, in this embodiment, can be a translucent, disk-shaped, Fresnel lens defining a circular shape with a recessed central region 4. The translucent region 8 is a concentric band around the recessed central region 4 of the lens 2, and the decorative flange 6 is a concentric band around the translucent region 8. The decorative flange 6 can be a part of, that is a radial extension of, the lens 2. The decorative flange 6 alternatively can be a part of the base component, such as extending normal to the open end 12 of a light housing 35 as shown in FIG. 11, in which case the decorative flange 6 would be considered one of the components making up the lens component. The recessed central region 4 may be filled with an aesthetic material to match or compliment the surrounding mounting surface 16 around the light system 1 (best seen in FIGS. 3, 5, 7, and 9). The recess 14 in the decorative flange 6 also may be filled with an aesthetic material to match or compliment the surrounding mounting surface 16 around the light system 1 (best seen in FIGS. 3, 5, 7, and 9); however, in FIG. 1 the recess 14 in the decorative flange 6 is filled with the material 10 to match, compliment, or contrast with the recessed central region 4.

In this way: the light system 1 efficiently and effectively inserts, embeds, installs, or insets into, or through, the side wall(s) or floor defining the mounting surface 16. The lens 2 portion preferably is structured so as to be of a reduced profile, that is, flat, shallow domed, etc., so as to reduce contact with a user or pool equipment.

Figure 2:
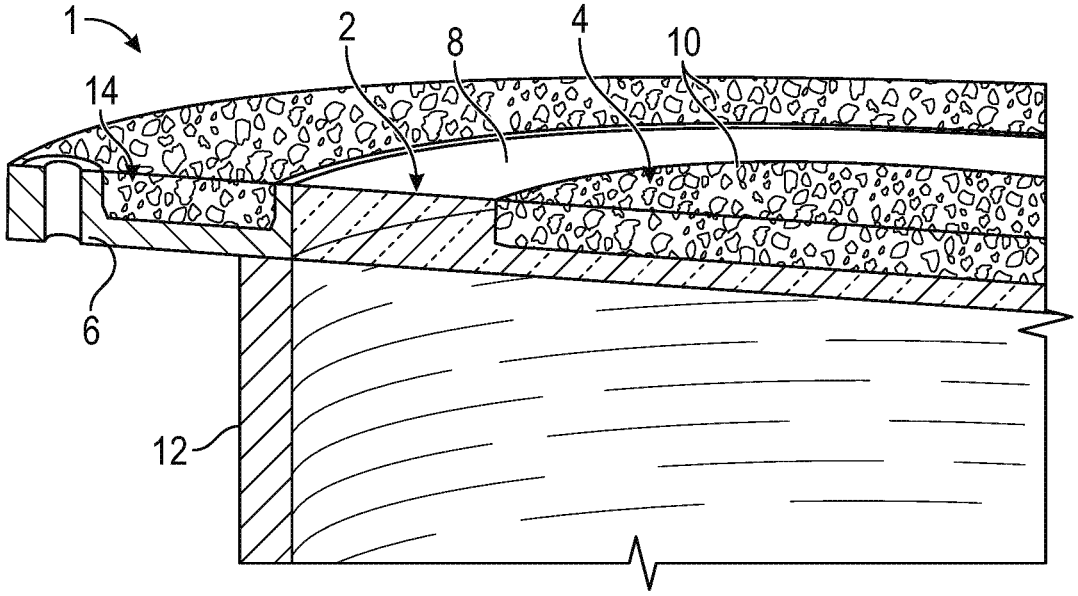
FIG. 2 is a sectional perspective view of the flanged light system of FIG. 1.

FIG. 2 is a sectional perspective view of the light system 1 of FIG. 1. The lens 2 is attached normal to the first open end 12 of the tubular body of the base component. The lens 2 defines a recessed central region 4 formed into, but not through, the material of lens 2, and taking the shape of a bulls-eye from a front-facing perspective. When the recessed central region 4 is filled with the filler material 10, the filler material 10 obfuscates or completely obstructs the illuminated recessed central region 4 of the lens 2. Alternatively, the filler material 10 may be at least in part translucent or patterned to provide for a glowing effect in the central region 4. For example, the filler material 10 also can comprise a mixture of different materials, or include holes, to produce a patterned effect. The filler material 10 may be fashioned to be concave, flat, or convex. A separate cap 24 (see FIG. 4) also may be installed to obfuscate or completely obstruct the illuminated recessed central region 4 of the lens 2, or to allow the light to be redirected. The decorative cap may have a decorative design thereon. The decorative cap 24 also can have holes or a punched design therethrough to allow for light to show through in a desired design or lighting effect.

The decorative flange 6 bounds the outermost circumference or perimeter of the lens 2 and defines a recessed region 14 formed by the material of the flange 6. The recessed region 14 of the decorative flange 6 also is filled with a material 10 to match or compliment the recessed central region 4. Unlike the filler material 10 of lens 2, the filler material 10 of the decorative flange 6 does not necessarily obfuscate or affect illumination of the flange 6. This is only because the decorative flange 6 of this embodiment does not illuminate separately from the lens 2. An illuminating flange 6, however, is envisioned as a possible feature of another embodiment.

In this way: the decorative flange 6 and the central region 4 sandwich the to-be-illuminated halo 8 of the lens 2; the halo 8 defines a first concentric band around the central region 4 bull's-eye, and the decorative flange 6 defines a second concentric band around the halo 8 and the central region 4 bull's-eye. Although the term "bull's-eye" is used herein, the light system 1 does not need to be circular, and other shaped "bull's-eyes" are contemplated, such as concentric triangles, rectangles, and other geometric figures.

Figure 3:
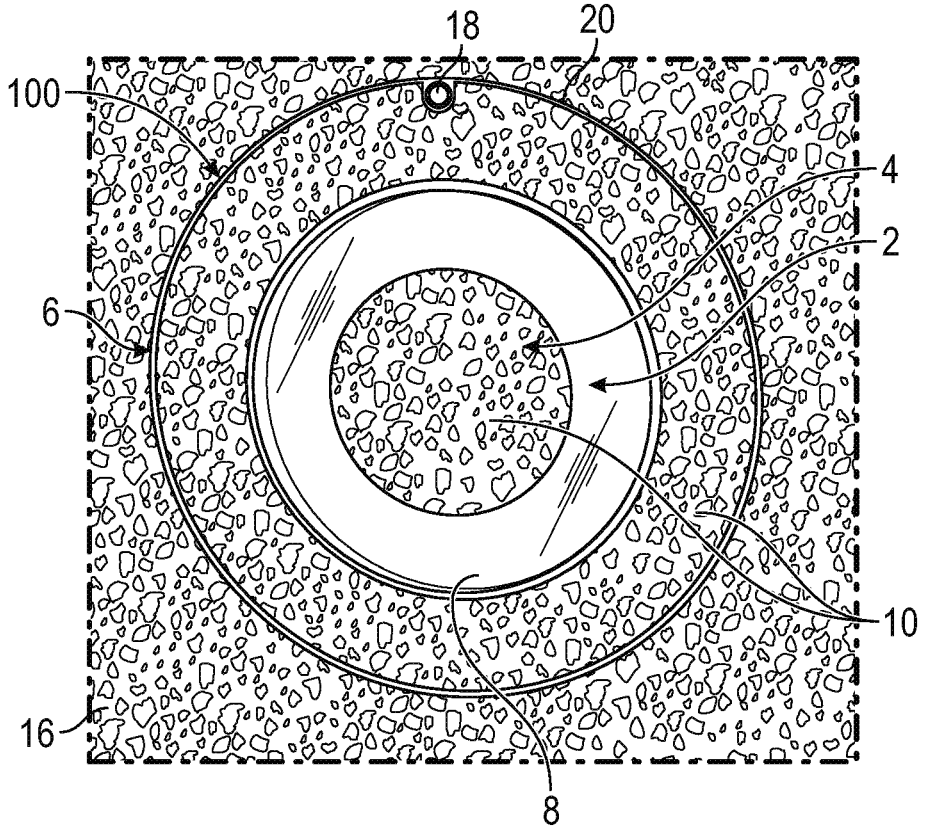
FIG. 3 is a front perspective view of another exemplary embodiment of a flanged light system according to the invention.

FIG. 3 is a perspective view of another exemplary embodiment of a light system 100. The light system 100 is identical to the light system 1 of FIGS. 1-2, but for the differences described herein. The light system 100 comprises a disk-shaped lens 2 mechanically retained by a pool niche (see FIG. 20). The light system 100 is embedded into the wall/surrounding mounting surface 16, as is understood by a person having ordinary skill in the art. The lens 2 is securely engaged via a fastener 18, or the fastener 18 provides a single mounting point to the pool niche. The light system 100 has the halo 8 illuminated, and a light source is activated to illuminate the halo 8. The recessed central region 4 of the lens and the recessed region 14 of the flange 6 are filled with an aesthetic material 10 to match the surrounding mounting surface 16 around the light system 100. A visible portion 20 of the flange 6 is comprised of a material to match the tones of the surrounding mounting surface 16.

Figure 4:
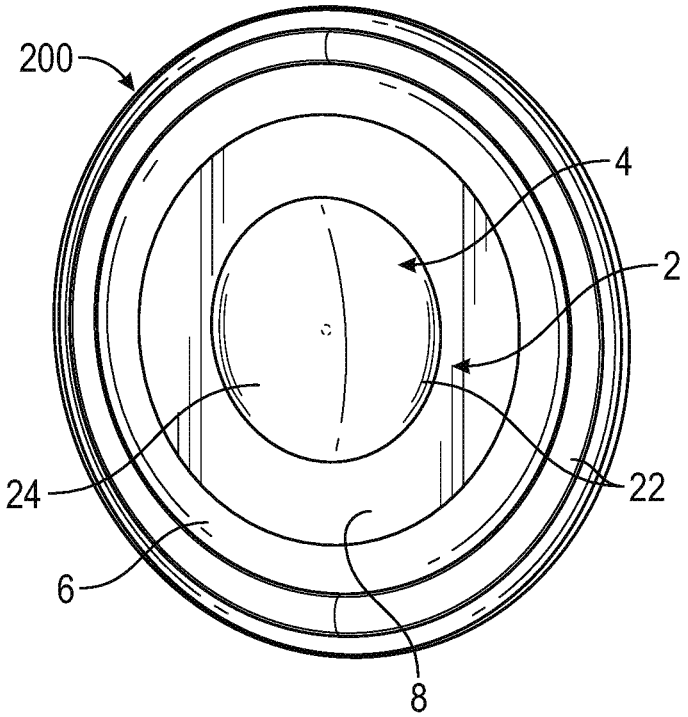
FIG. 4 is a front perspective view of another exemplary embodiment of a flanged light system according to the invention.

FIG. 4 is a perspective view of another exemplary embodiment of a light system 200. The light system 200 is identical to the light system 1 of FIGS. 1-2, but for the differences described herein. The decorative flange 6 bounds the outermost circumference of the lens 2, and the decorative flange 6 and the central region 4 of the lens 2 sandwich the visible region 8 of the lens; however, the decorative flange 6 is not configured to receive a "masking", "hiding", filler, or bonding material. The decorative flange 6, instead, is made of stainless steel, color coordinated plastic, or any other decorative material.

FIG. 4 also illustrates the use of a cap 24 that is installed to obfuscate the recessed central region 4 of the lens 2. In embodiments without the cap 24, the recessed central region 4 may be filled with stainless steel, color coordinated plastic, or any other decorative material to match or compliment the decorative flange 6. The recessed central region 4 may contain grooves, snaps, or other features to help mechanically fasten the cap 24, and also may contain ribs, barbs, anchors, or other features to help mechanically fasten other filler materials 10 such as particulate or aggregate material. Alternatively, the cap 24 or filler materials 10 may be fastened using glue, adhesive, epoxy, double-sided tape, or other means of fastening.

Figure 5:
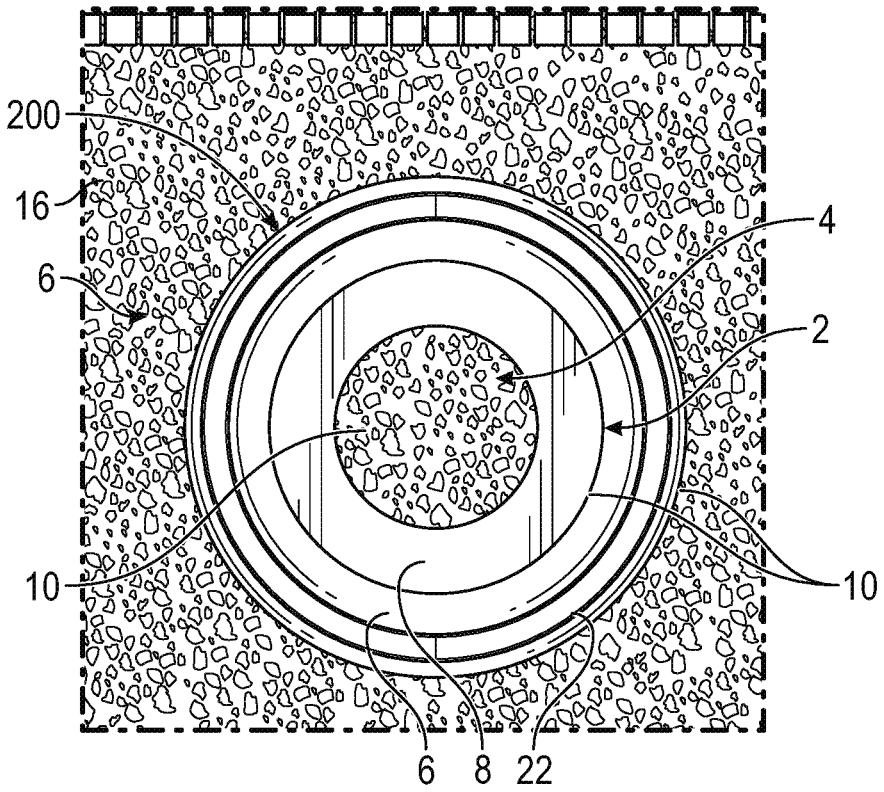
FIG. 5 is a front perspective view of the flanged light system of FIG. 4 but with a cap component removed and an aesthetic material substituted therefor.

FIG. 5 is a perspective view of the light system 200 of FIG. 4 but with the cap 24 removed. The recessed central region 4 of the lens 2 is filled with the filler material 10 to completely obstruct the illuminated recessed central region 4 of the lens 2 and to match the surrounding mounting surface 16 around the light system 100. The halo 8 is illuminated and a light source is activated to illuminate the halo 8. The visible portion 20 of the flange 6 is comprised of a material and color to match or compliment the tones of the surrounding mounting surface 16.

Figure 6:
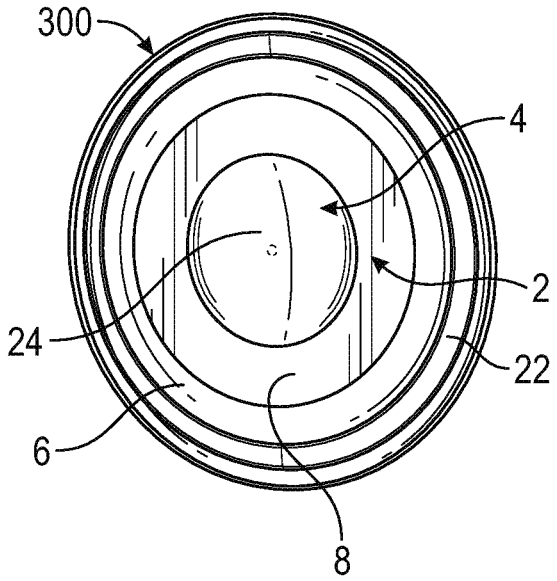
FIG. 6 is a front perspective view of another exemplary embodiment of a flanged light system according to the invention.

FIG. 6 is a perspective view of another exemplary embodiment of a light system 300. The light system 300 is identical to the light system 200 of FIGS. 4-5, but for the differences described herein. The lens 2 of the light system 300 is about 6.0 inches in diameter, preferably between 5.0 and 7.0 inches in diameter, while the lens 2 of the spa light system 200 is about 10.0 to 11.0 inches in diameter, preferably between 9.0 and 13.0 inches in diameter. Either system 200 or 300 are capable of universally replacing other third-party lights made by competitors, whether with or without an adapter. For example, the decorative flange 6 portion preferably is sized to extend and cover the niche or existing wall fitting.

Figure 7:
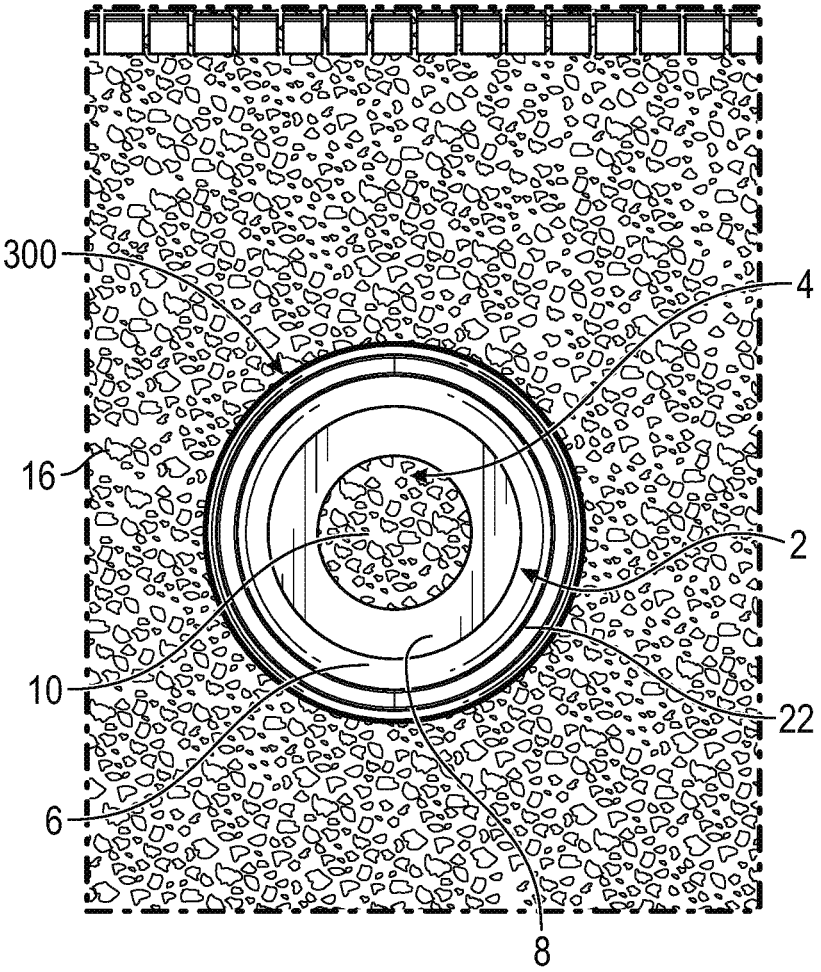
FIG. 7 is a front perspective view of the flanged light system of FIG. 6 but with the cap removed and an aesthetic material substituted therefor.

FIG. 7 is a perspective view of the light system 300 of FIG. 6 but with the cap 24 removed and a filler material 10 inserted into the recess 4.

Figure 8:
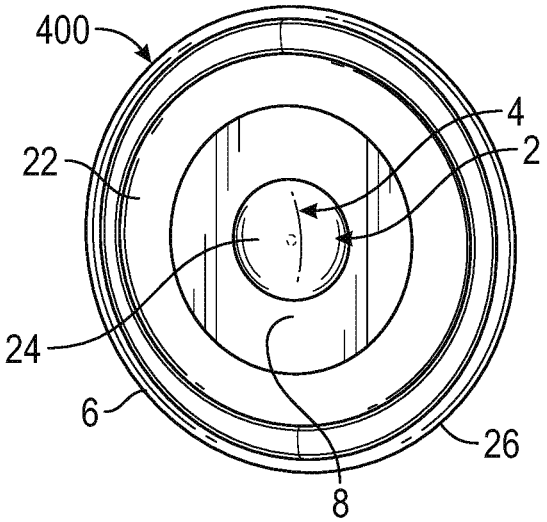
FIG. 8 is a front perspective view of another exemplary embodiment of a flanged light system according to the invention.

FIG. 8 is a perspective view of another exemplary embodiment of a light system 400. The light system 400 is identical to the light system 300 of FIGS. 6-7, but for the differences described herein. The lens 2 of the light system 400 is about 1.5 to 5.0 inches in diameter, with a common size being 2.25 inches in diameter. A common niche or passage size in about 1.5 inches in diameter, and the housing or body should be sized so as to fit within the niche or passage. The cap 24 is made of stainless-steel material 26 to completely obstruct the illuminated recessed central region 4 of the lens 2.

Figure 9:
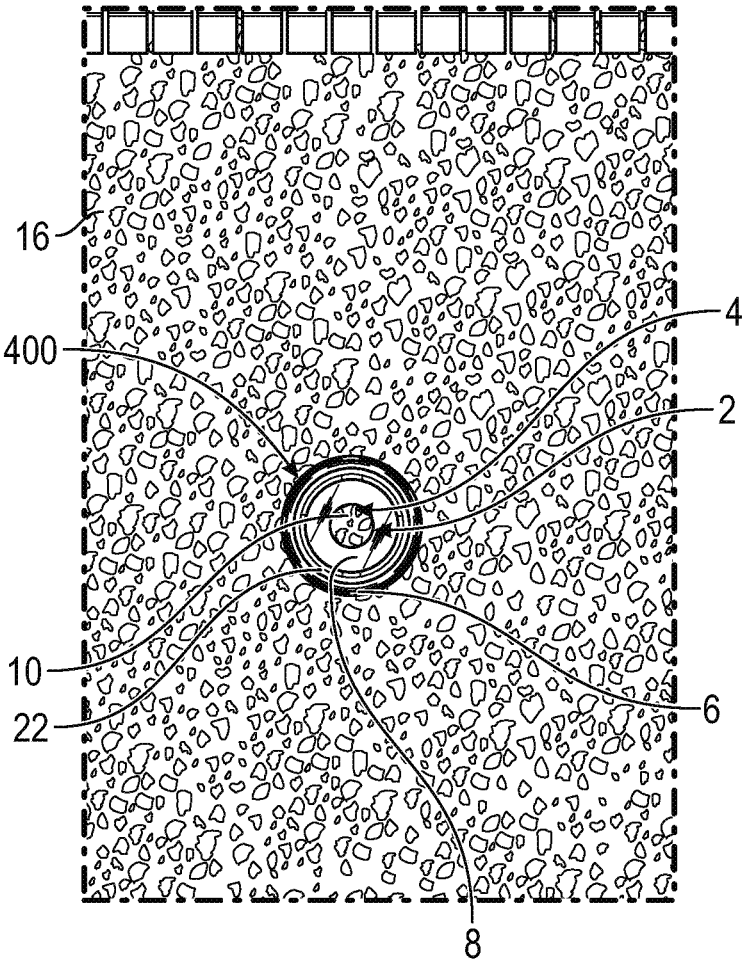
FIG. 9 is a front perspective view of the flanged light system of FIG. 8 but with the cap removed and an aesthetic material substituted therefor.

FIG. 9 is a perspective view of the light system 400 of FIG. 8 but with the cap 24 removed and a filler material 10 inserted into the recess 4. The system 400 is capable of universally fitting into proprietary or third-party standard wall fittings or pipes.

FIGS. 10-19 provide additional detail for the embodiments of the flanged embodiments of the invention in, and described in connection with, FIGS. 1-9.

Figure 10:
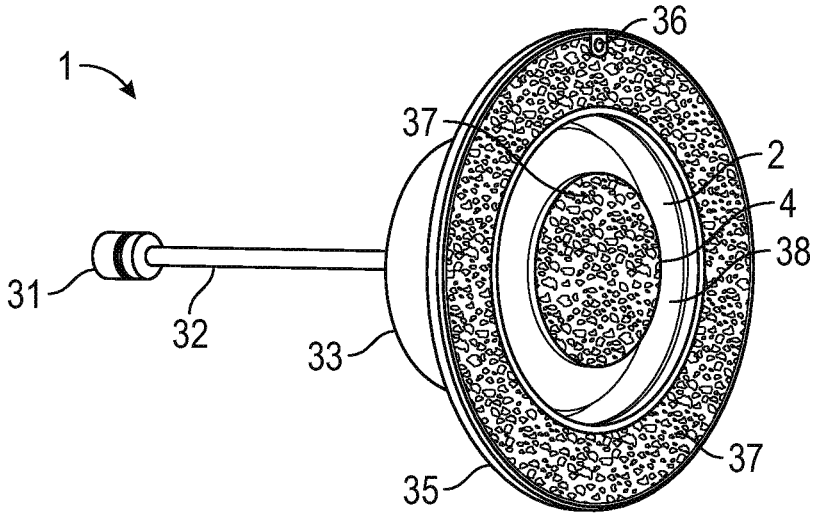
FIG. 10 is a perspective side view of the flanged light system of FIG. 1 with a flange as part of a housing.

FIG. 10 is a perspective side view of the light system 1 of FIG. 1 for use in a standard inground pool niche. The light system 1 comprises a connector 31, preferably a waterproof quick connect/disconnect connector for connecting the light system to an electrical system for the pool or spa and a cable 32 to the lighting array and internal electronics. The connector 31 connects to a mating connector on a longer (e.g., 50-100 foot) cable (not shown) in the conduit or passage. The longer cable connects to the electrical system for powering the pool or spa, including the light system 1. The connector 31 allows for the light system 1 to be replaced without having to pull the longer 50-100 foot cable out of the conduit or passage and fishing in a new 50-100 foot cable with the new replacement light system 1. Replacing the longer cable can be difficult and the present invention helps in avoiding such a need for replacing the longer cable.

A light housing 33 is constructed comprising a cup-like structure for containing the lighting array and the internal electronics. A lens 38 is sealed onto the light housing 33 using known devices, such as gaskets or seals 34 (not shown in FIG. 10). The light housing 33 comprises a light flange 35 extending radially outwards from the cup-like structure as previously described, with the light flange 35 comprising a recess 14 for containing an aesthetic surface material 37 such as material 10. The lens 38 also comprises a recess 4 for containing an aesthetic surface material 37. If desired, the aesthetic surface material may match the surface material of the spa wall. One or more mounting screw holes 36 can be provided for mounting the light flange 35 to the spa wall.

FIG. 11 is a perspective side sectional view of the light system 1 of FIG. 10. In FIG. 11, both a preferred embodiment of the contour of the light flange 35 and the lens 38 and of the lighting array and the internal electronics 82 of the device 1 can be seen. The light flange 35 has a generally U-shape contour with a bottom and side walls providing a recess 14 structure for holding the aesthetic surface material 37. Similarly, the lens 38 comprises a central recess 4, circular in this embodiment, for holding the aesthetic surface material 37 or some other aesthetic device, such as a cap 24 or covering. The cap 24 or covering can be a different material, such as stainless steel, colored plastic, vinyl, acrylic, fiberglass, etc. The lens 38 comprises an unobstructed portion 2 for allowing light to pass through and be seen.

As shown in the exemplary embodiment of FIG. 11, the lighting array and internal electronics 82 comprise at least one LED array 39 mounted on at least one printed circuit board 40 and various known electronic components 41 for providing electrical current to and operating the LED array 39. The LED array 39 and the printed circuit board 40 are arranged within the light housing 33 such that light emitted from at least a portion of the LED array 39 is emitted through and/or can be seen through the lens 38 when the LED array 39 is energized. The LED array 39 may be arranged to be hidden behind the obscured center recess 4, which can provide a more muted lighting effect for accent lighting. Alternatively, the LED array may have directional optics to direct light out around the obscured center recess 4 for a brighter effect. Cable 32 extends through a hole 84 in the base of the light housing 33 and is held in place by a known device such as a strain relief fitting 42. Various electronics 82 components can include, for example, heat sinks, transformers, additional printed circuit boards, timers, switches, etc.

Figure 12:
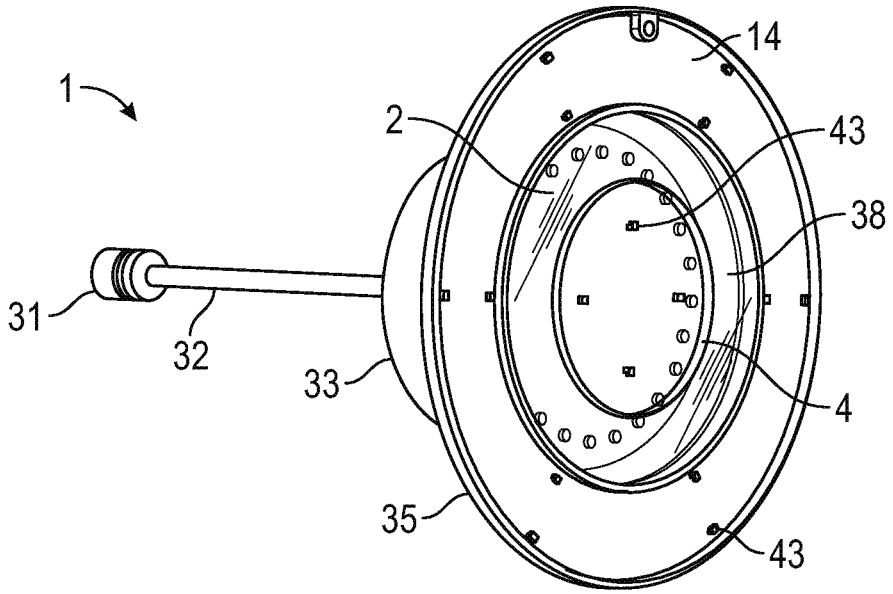
FIG. 12 is a perspective side view of the flanged light system of FIG. 10 without the aesthetic surface material and showing optional features to mechanically hold the aesthetic surface material.

FIG. 12 is a perspective side view of the light system 1 of FIG. 10 without the aesthetic surface material 37 and showing optional features to mechanically hold the aesthetic surface material 37. Such optional features are shown in the form of tabs 43 to which the aesthetic surface material 37 can secure as the aesthetic surface material 37 dries during installation. The tabs 43 can be located both within the recess of the light flange 35 and within the recess in the lens 38.

Figure 13:
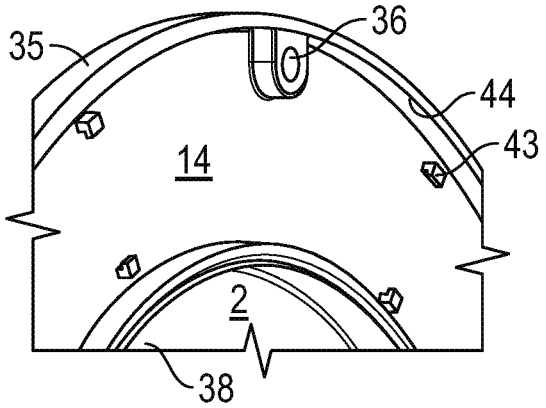
FIG. 13 is an enlarged perspective side view of the flanged light system of FIG. 10 without the aesthetic surface material and showing optional features and a lip on the upper edges of the recess wall to mechanically hold the aesthetic surface material.

FIG. 13 is a perspective side view of the light system 1 of FIG. 10 without the aesthetic surface material 37 and showing optional features in the form of tabs 43 within the recess 14 and a lip 44 (see FIG. 19 for detail) on the upper edges of the recess 14 wall to mechanically hold the aesthetic surface material 37 within the recess 14. The upper lip 44 can curve inwardly towards the center of the recess such that the aesthetic surface material 37 dries underneath the upper lip 44 during the installation process. Other features for retaining the aesthetic surface material 37 within the recesses 4, 14 also are suitable.

Figure 14:
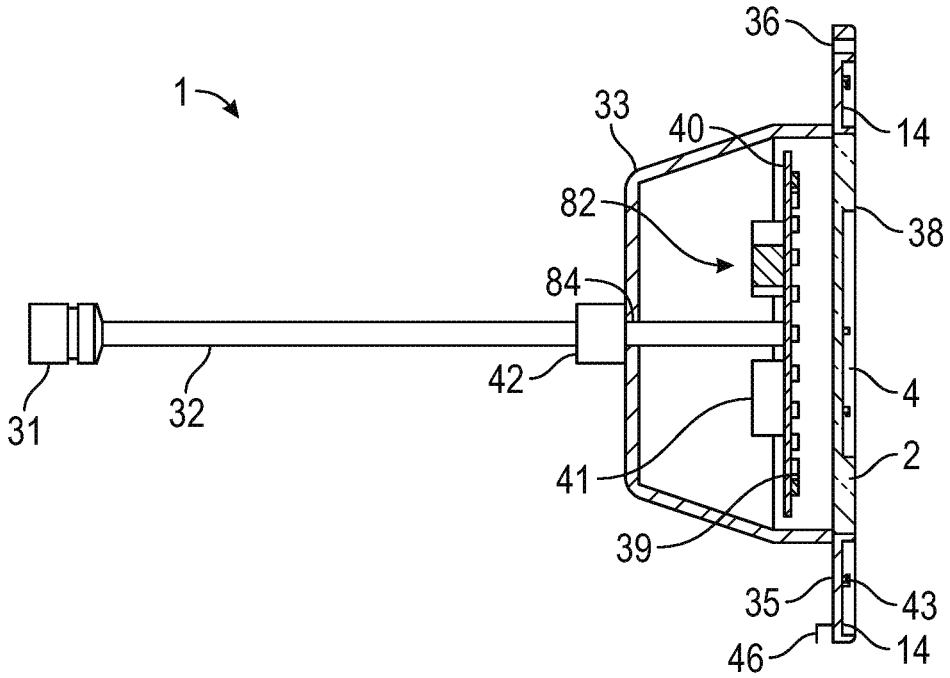
FIG. 14 is a side sectional view of the flanged light system of FIG. 10.

FIG. 14 is a side sectional view of the light system 1 of FIG. 10. Similar to FIG. 11, in FIG. 14, both a preferred embodiment of the contour of the light flange 35 and the lens 38 and of the lighting array and the internal electronics 82 of the device 1 can be seen in more detail. The light flange 35 has a generally U-shape contour with a bottom and side walls providing a structure for holding the aesthetic surface material 37 (not shown in FIG. 14). Similarly, the lens 38 comprises a central recess 4 for holding the aesthetic surface material 37 or some other aesthetic device, such as a cap 24 or covering. The lens 38 comprises an unobstructed portion 2 for allowing light to pass through and be seen. As shown in greater detail in FIG. 14, the lighting array and internal electronics 82 comprise at least one LED array 39 mounted on a printed circuit board 40 and various known electronic components 41 for providing electrical current to and operating the LED array 39. The LED array 39 and the printed circuit board 40 are arranged within the light housing 33 such that at least a portion of the LED array 39 can be seen through the lens 38 when the LED array 39 is energized, and can be considered generally on a parallel plane to the lens 38. Cable 32 extends through a hole 84 in the base of the light housing 33 and is held in place by a known device such as a strain relief fitting 42.

FIG. 14 also shows a retainer tab 46 that can engage with a corresponding slot in the niche, the niche wall, or the pool or spa wall to attach and lock the light housing 33 or the light flange 35 (or the lens 38 with a light flange 35 combination as discussed in connection with FIG. 15) to the wall. For example, as discussed in connection with FIGS. 23A-D, the light flange 35 portion can be installed on the pool or spa by holding the light system 1 at an angle to the niche or niche box 90, engaging the retainer tab 46 into the slot 92 of the niche, pivoting the light system 1 into the niche, and then installing a mounting screw through the mounting screw hole 36 into the pool or spa wall.

Figure 15:
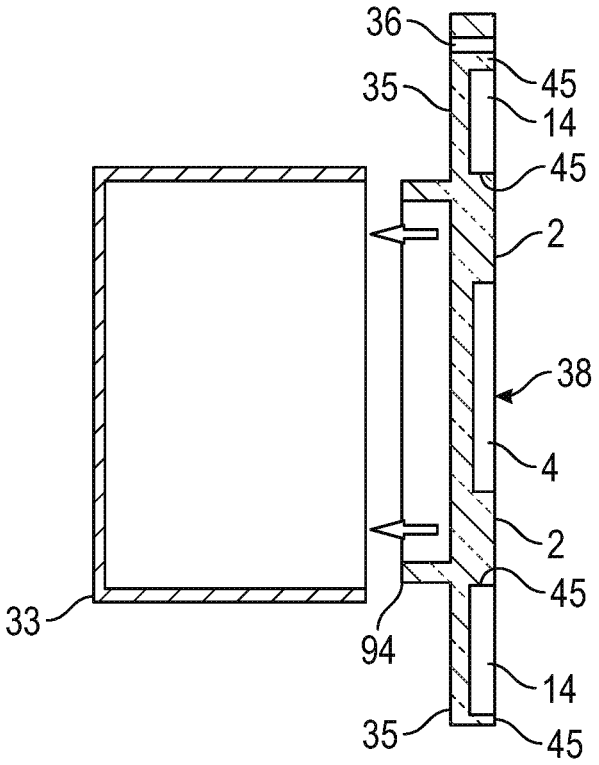
FIG. 15 is a side sectional view of a flanged light system similar to that of FIG. 10, but with a single-component lens and flange embodiment.

FIG. 15 is a side sectional view of a light system 1 similar to that of FIG. 10, but with a single-component lens 38 and flange 35 embodiment. In the embodiments shown in FIGS. 12-14, the light flange 35 and the lens 38 are separate components, with the lens 38 being mountable within a central opening of the light flange 35. Alternatively, as shown in FIG. 15, the light flange 35 and the lens 38 can be a single component, made out of transparent or translucent lens material, that is secured onto an open top portion 12 of the light housing 33. In such a single component embodiment, which can be considered a lens 38 with a lens flange 35, the lens 38 is essentially divided into three portions, a central recess portion 4, a middle lens 2 portion and an outer flange 35 portion, all made of lens material. The three portions can be separated by raised walls 45 so that the aesthetic surface material 37 within the central recess portion 4 and the outer flange 35 portion will not migrate into the middle lens 2 portion. The lens 38 with a lens flange 35 combination can then be attached to the light housing 33 with threads, ultrasonic welding, heat welding, bayonet locks, adhesives, or other known methods of attachment, such as attachment foot 96 extending axially from the back of the lens 38.

Figure 16:
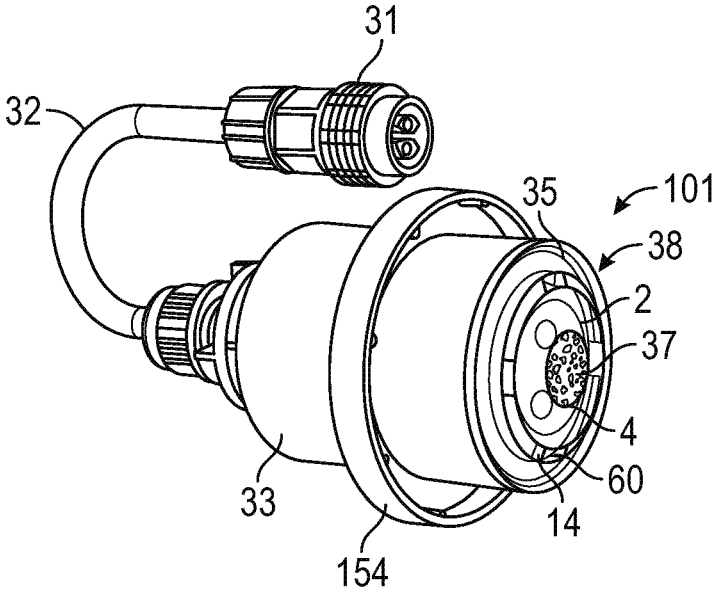
FIG. 16 is a perspective side view of a nicheless flanged light suitable for use in the present invention.

FIG. 16 is a perspective side view of a nicheless light system 101 suitable for use in the present invention. This nicheless light system 101 typically is for mounting directly in a gunite or concrete wall of a pool or spa, and not in a niche. More specifically, when the pool or spa is manufactured, the light housing 33 is attached to rebar and the wet or unhardened gunite or concrete is applied around the light housing 33, which remains as a permanent feature when the gunite or concrete sets and hardens. The nicheless light system 101 comprises similar or analogous components as the light system 1 shown in FIG. 10, such as a connector 31, a cable 32, lighting LED array 39 and internal electronics 82, a light housing 33, and a lens 38 with a light flange 35 and/or at least one recess 4, 14 for containing an aesthetic surface material 37. The light housing 33 further comprises a water stop 154 extending radially outwardly from a generally central location on the light housing 33. The water stop 154 both helps retain the light housing 33 in the gunite or concrete and also provides a barrier or stop helping to prevent water seeping between the gunite or concrete and the outer surface of the light housing 33 from seeping or leaking out of the pool or spa.

Figure 17:
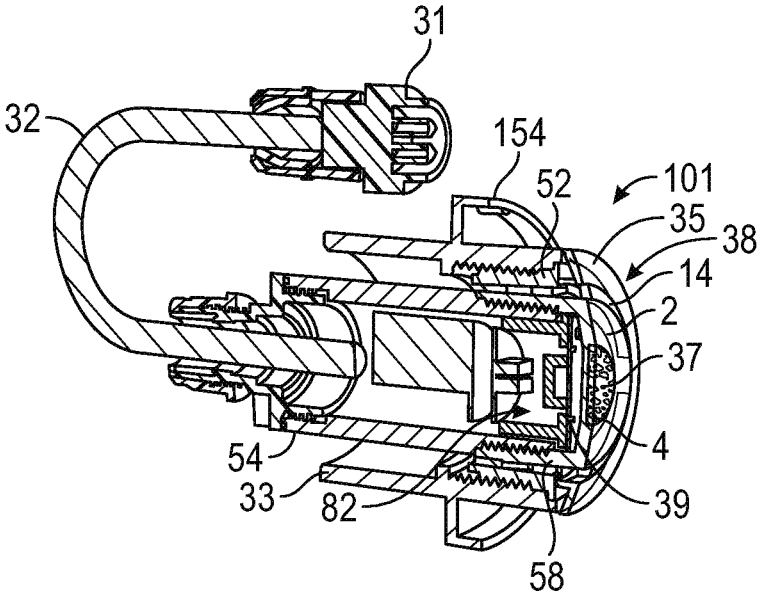
FIG. 17 is a perspective side sectional view of the nicheless flanged light of FIG. 16.

FIG. 17 is a perspective side sectional view of the nicheless light system 101 of FIG. 16. Generally, the internal arrangement of components for the nicheless light system 101 also is similar or analogous to the internal arrangement of components for the light system 1 of FIG. 10. However, an exemplary embodiment of the nicheless light system 101 can comprise three primary components: light housing 33 component, lens 38 and lens mounting component 52, and tubular light structure 54. Tubular light structure 54 contains the light array and electronic components, such as the LEDs 39 and printed circuit board(s) 40 at one end and the cable 32 extending out the opposite end. At the light array end, tubular light structure 54 has a male thread for cooperating with a female thread on the lens 38. In this manner, tubular light structure 54 can be releasably secured to the lens 38 to create a water-tight or water-proof structure to protect the LEDs 39, printed circuit board 40, and the other electronic components located within the tubular lighting structure 54. As one of ordinary skill in the art will understand, the tubular light structure 54 and the threaded region of the lens 38 can be circular in cross-section, with the light housing 33, flange 35, and lens 38 itself being different geometrical configurations. In this manner, a common tubular light structure 54 can be used in combination with various different shaped light housings 33, flanges 35, and lenses 38.

Light housing 33 is a generally hollow tubular component mounted within the gunite or concrete wall. Light housing 33 has an internal female thread on the pool or spa end of the light housing 33 for cooperating with a male thread on or attached to the lens 38, or on a lens mounting component 52

(see FIG. 17 and the description thereof). In this manner, lens 38, along with tubular light structure 54, can be releasably secured to the light housing 33 and thus mounted in the pool or spa wall. Thus, tubular light structure 54 is screw-mounted to lens 38, and the combination lens 38 and tubular light structure 54 can be screw-mounted to light housing 33, or snapped into the light housing 33 (see FIG. 17 and the description thereof), or even welded or adhesively affixed to the light housing 33 for a more permanent manner of attachment. The releasable configurations result in the ability to replace the lens 38 should the lens 38 break or if a new, different lens 38 is desired, and to replace the light array and electronic components should either of them fail. Alternatively, any or all of the components can be permanently attached to each other by, for example, adhesives or welding.

Figure 18:
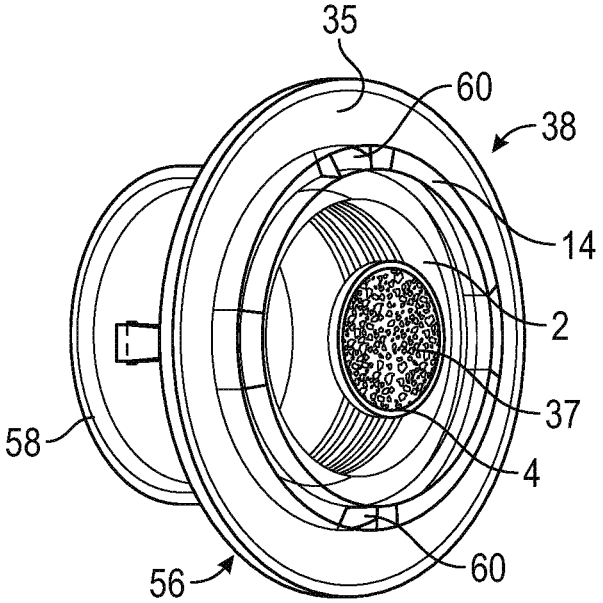
FIG. 18 is a perspective side view of a lens for holding aesthetic surface material suitable for use with the present invention, such as in combination with the nicheless flanged light of FIG. 16.

FIG. 18 is a perspective side view of a lens 38 for holding aesthetic surface material 37 suitable for use with the nicheless embodiment of the present invention, such as in combination with the nicheless light of FIG. 16. In this embodiment the lens 38 and light flange 35 are part of a single, unitary component constructed of lens material, such as a transparent or translucent material. Lens 38 comprises a component similar to the lens 38 shown in FIGS. 1-2 and 10-15, namely, a lens 38 with at least one recess for holding aesthetic surface material 37. Specifically, Lens 38 of FIG. 18 has a lens disk 56 central recess 4, a middle lens component 2, an optional outer annular recess 14, and a light flange 35 portion.

Lens 38 further comprises a mounting cylinder 58 extending perpendicular from a back side of the lens disk 56, namely the side of the lens disk 56 that does not face into the interior of the pool or spa. Depending on the shape and structure of the pool or spa, or of the lens 38, mounting cylinder 58 can extend at various angles form the lens disk 56, but preferably extends at an angle of 45-90 degrees, and more preferably an angle of 60-90 degrees. Mounting cylinder 58 comprises an internal female thread for cooperating with the external male thread of tubular light housing 54 as previously disclosed.

Mounting cylinder 58 further comprises a means for mounting the lens 38 onto the light housing 33. The means for mounting may comprise an external mounting surface 66 for attaching to a lens mounting component 52, shown in FIG. 17. The lens mounting component 52 is a sleeve-like structure that fits over and is preferably secured to the external mounting surface 66 using a bayonet or tab lock device (not shown, but known in the art). For example, the lens mounting component 52 can comprise a male thread on the external surface of the sleeve-like structure and tabs or bayonet features on the internal surface of the sleeve-like structure. In this embodiment, the lens mounting component 52 screws into the light housing 33, and the lens 38 with the tubular structure 54 attached thereto is snapped into the lens mounting component 52. In this manner, tubular light structure 54 can be releasably secured to the lens 38 to create a water-tight or water-proof structure to protect the LEDs 39, printed circuit board 40, and the other electronic components located within the tubular lighting structure 54. The external mounting surface 66 of the mounting cylinder 58 is pushed past the tabs or bayonet features, which undergo plastic or elastic deformation, until the external mounting surface 66 passes completely by the tabs or bayonet features, at which point the tabs or bayonet features snap back so as to hold the mounting cylinder 58 within the lens mounting component 52.

Lens mounting component 52 has an external male thread for cooperating with the internal female thread of light housing 33 for releasably securing lens 38 and lens 38 and tubular light structure 54 to light housing 33. Alternatively, instead of external mounting surface 66, mounting cylinder 58 can comprise an external male thread directly on the outer surface of mounting cylinder 58 for cooperating directly with the internal female thread of light housing 33. The lens mounting component 52 can be a part of the flange 35 or faceplate whereby a flange 35 or faceplate can be used that comprises the lens mounting component 52 as a back part, extending normal or at an angle from the flange 35 or faceplate, so that the flange 35 or faceplate, as a separate part from the lens 38, can screw into the light housing 33, and the lens 38 can tab- or bayonet-mount into the flange 35 or faceplate. In this manner, the flange 35 or faceplate can cover and hide preexisting spaces, components, or features.

The lens disk 56 optionally may comprise openings 60, typically through the outer annular recess 14 regions. These openings 60 can be used for anchoring a removal tool for removing the lens 38 or the lens 38 and tubular light structure 54 from the light housing 33. Additionally, these openings 60 can allow water to pass through lens 38 into the fitting or the passageway through the gunite or concrete for cooling the light system 101. The use of an external mounting surface 66, which separates the lens mounting component 52 from the outer surface of the mounting cylinder 58, allows for a volume between the mounting cylinder 58 and the lens mounting component 52 in which the cooling water can access through the openings 60.

Figure 19:
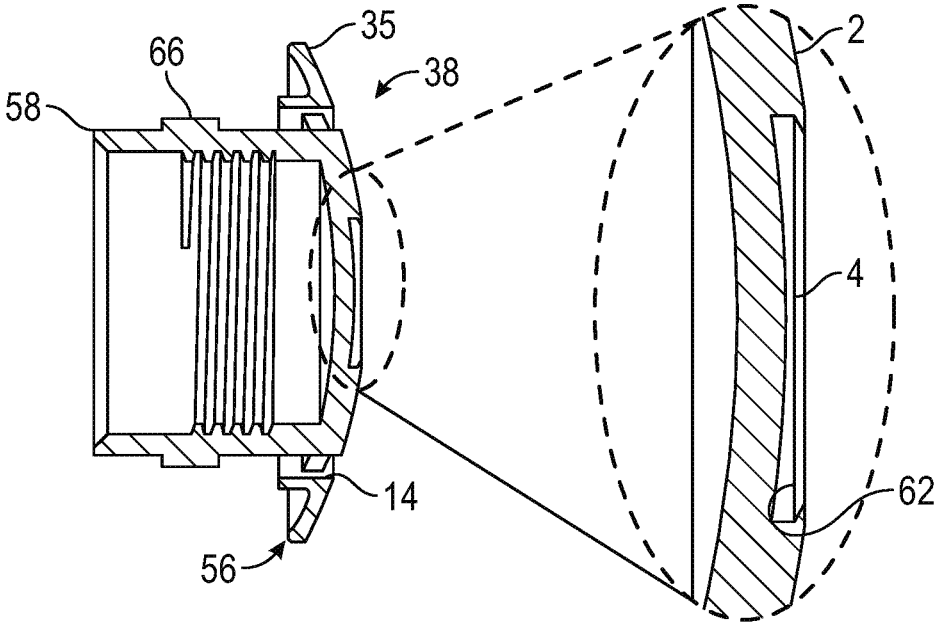
FIG. 19 is a side sectional view of the lens of FIG. 18 with an enlarged view of the central recess for holding aesthetic surface material and the lip of FIG. 13.

FIG. 19 is a side sectional view of the lens of FIG. 18 with an enlarged view of the central recess for holding aesthetic surface material 37. Optional lip 62 extending inwardly at the outer surface of the lens 38 disk surrounding the central recess provides for an additional means for retaining aesthetic surface material 37 within the central recess. The lip 62 may be continuous or discontinuous.

Figure 20:
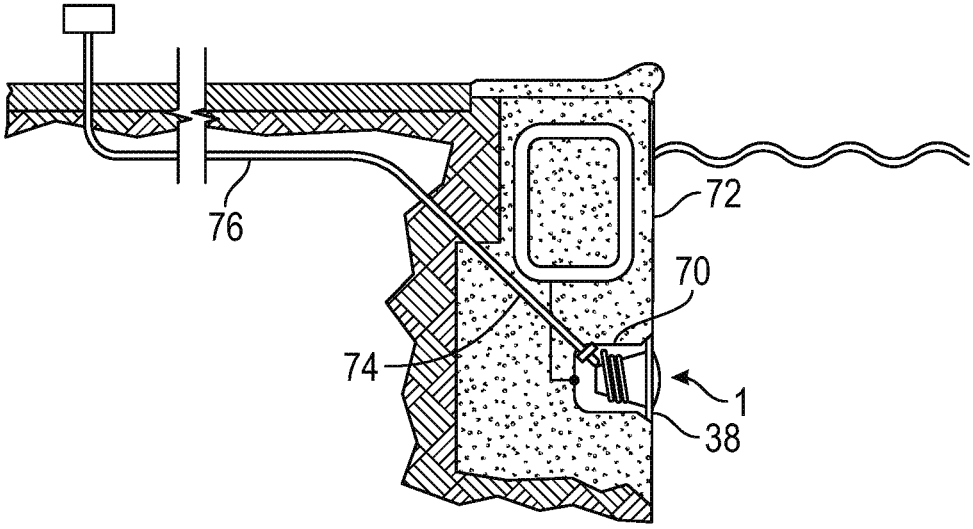
FIG. 20 is a side sectional view of a niche in a solid wall for holding a nicheless version of the light system of the present invention.

FIG. 20 is a side sectional view of a niche in a pool or spa wall for holding a niche version of the light system 1 of the present invention. Niche 70 is pre-formed in the wall 72 during the original installation of the pool or spa, or can be formed afterwards. Niche 70 can be any size and shape, and often is of a standard size and shape for holding light features or other features. Niche 70 often has a passageway 74 at the rear of the niche 70 and extending out of the pool or spa structure for allowing electrical wiring 76 to pass into the niche 70. The spa light system 1 can be inserted into and secured within the niche 70 as disclosed previously, with cable 32 connected to wiring 76 via connector 31. Thus, spa light system 1 can be removably and replaceably inserted into niche 70.

Figure 21:
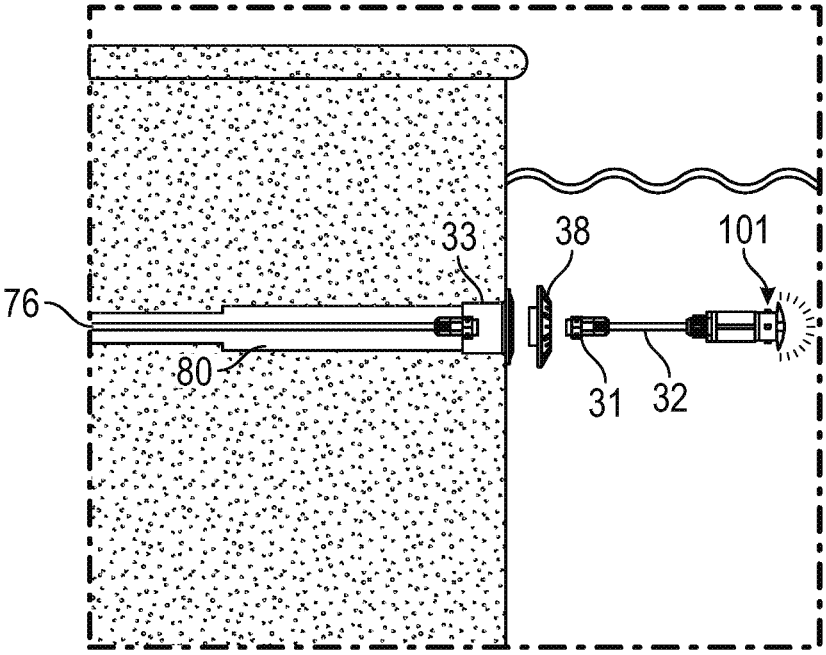
FIG. 21 is a side sectional view of a through-wall mounting for a through-wall version of the light system of the present invention.

FIG. 21 is a side sectional view of a nicheless, through-wall mounting for a through-wall version of the light system 101 of the present invention. Passageway 80 is pre-formed in the wall 72 during the original installation of the pool or spa, or can be formed afterwards. Passageway 80 can be any size and shape, and often is of a standard diameter for holding light features or other features. Passageway 80 extends out of the pool or spa structure for allowing electrical wiring 76 to pass through passageway 80. The light system 101 can be inserted into and secured within the passageway 80 as disclosed previously, with cable 32 connected to wiring 76 via connector 31. Thus, light system 1 can be removably and replaceably inserted into passageway 80.

In either of the installation manners shown in FIGS. 20-21, the lens 38 preferably is mounted flush to the pool or spa wall surface. However, due to the structure of the lens 38, the lens 38 often will protrude somewhat or slightly into the pool or spa interior. After the light system 1, 101 is mounted in the pool or spa wall and the lens 38 is attached to or located at the desired place, the lens 38 will contain aesthetic surface material 37 identical to or complimentary with the pool or spa wall and therefore the lens 38 will blend in with the pool or spa wall, creating a pleasing aesthetic look. When the light system 1, 101 is energized, light will be emitted from the lens 38 in the areas not covered by the aesthetic surface material 37 and create an aesthetically pleasing light display. Also, the aesthetic surface material 37 may at least in part be translucent to create a glowing light effect.

Figure 22:
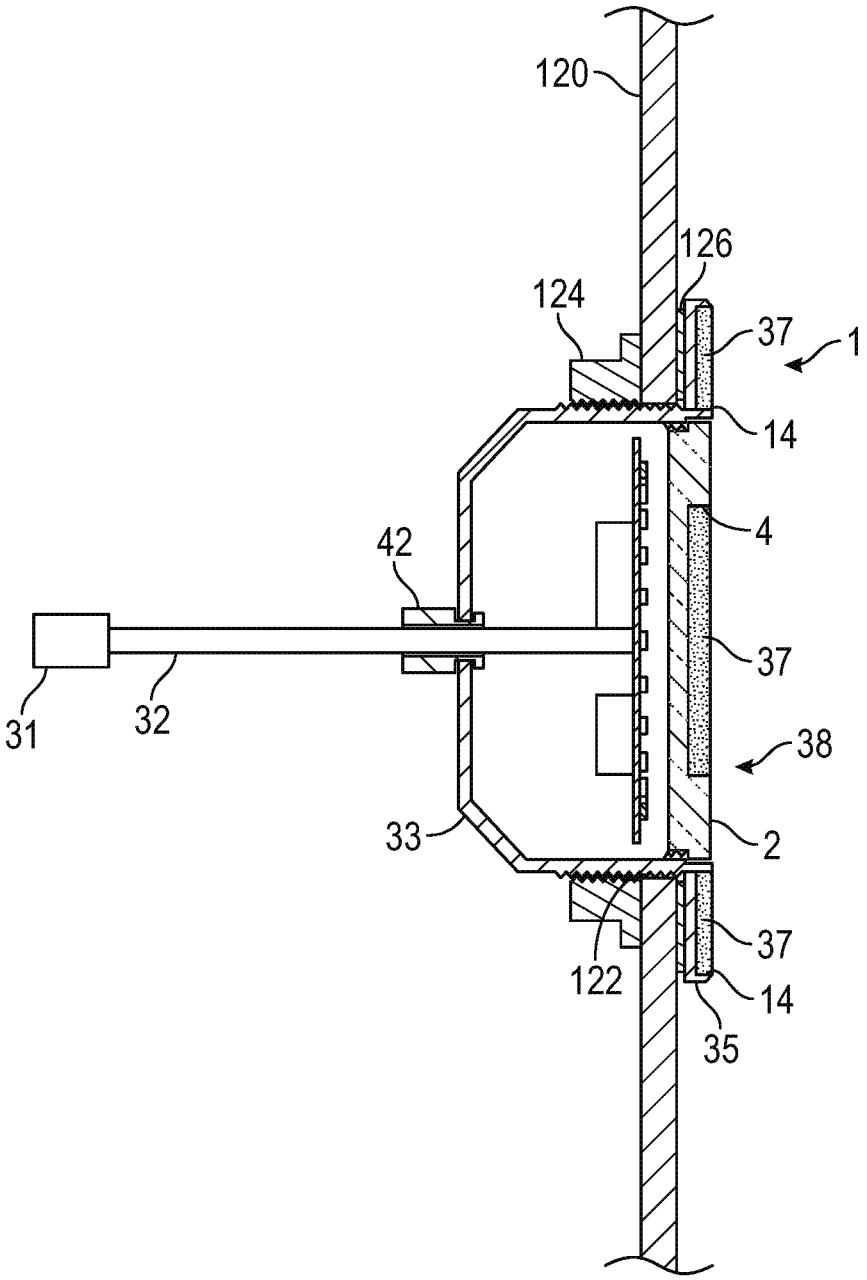
FIG. 22 is a side sectional view of through-shell mounting for a shell or liner mounted version of the flanged light of the present invention similar to the embodiment of FIG. 14.

FIG. 22 is a side sectional view of through-shell mounting for a shell or liner mounted version of the light system 1 of the present invention similar to that shown in FIG. 10. The light system 1 comprises a connector 31, preferably a waterproof quick connect/disconnect connector for connecting the light system 1 to an electrical system for the pool or spa (an example of which is disclosed previously) and a cable 32 to the lighting array with LEDs on a printed circuit board and other internal electronics. A light housing 33 is constructed comprising a cup-like structure for containing the lighting array and the internal electronics. A lens 38 is sealed onto the light housing 33 using known devices, such as gaskets or seals 34. The light housing 33 comprises a light flange 35 extending radially outwards from the cup-like structure as previously described, with the light flange 35 comprising a recess 14 for containing an aesthetic surface material 37. The lens 38 also comprises a recess 4 for containing an aesthetic surface material 37 or a cap 24 or covering. The housing 33 in this embodiment is in part cylindrical for fitting through a round hole in a shell wall. A male thread is formed on the outer surface of the cylindrical housing 33 wall to cooperate with the inner surface of a cooperating securing nut. The housing 33 is inserted through the hole 122 in the shell wall 120 and the nut 124 is tightened via the cooperating threads such that the shell wall 120 is sandwiched between the nut 124 and the flange 35, thus securing the housing 33 onto the shell wall 120. Another gasket 126 or seal can be placed between the flange 35 and the shell wall 120 for further waterproofing. This embodiment does not require a tubular structure 54 separate from the housing 33.

Figure 23A:
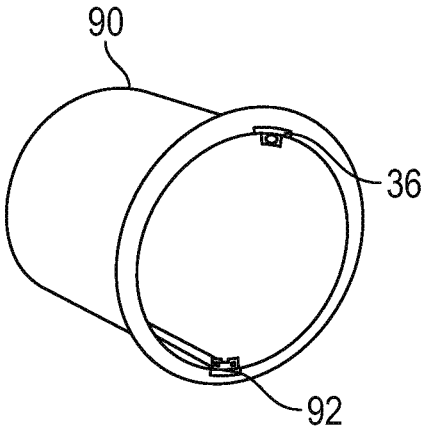
FIGS. 23A-D are schematic side perspective views of a manner for installing a flanged embodiment of the invention in a niche housing or box, with FIG. 23A being a view of a niche housing, FIG. 23B being a view of the light system and cable ready for placement in the niche housing, FIG. 23C being a view of the light system being attached to the niche housing using a tab and then rotated upwards for securing, and FIG. 23D being a view of the light system secured to the niche housing with a screw.
Figure 23B:
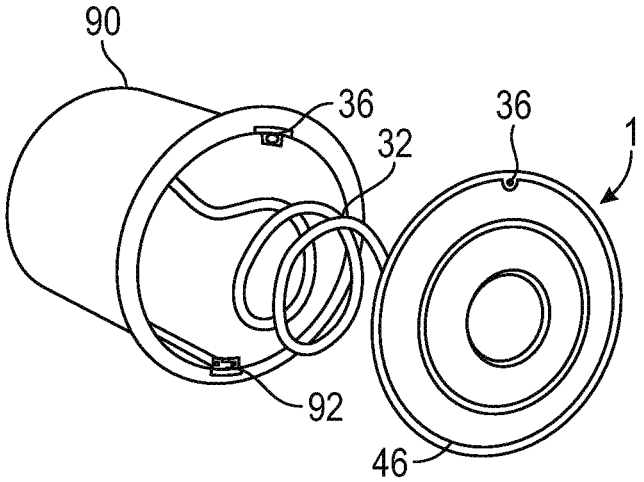
Figure 23C:
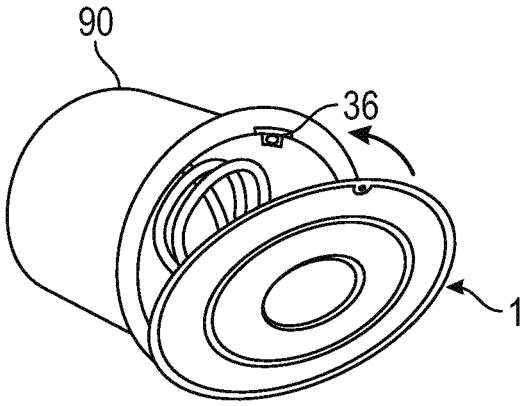
Figure 23D:
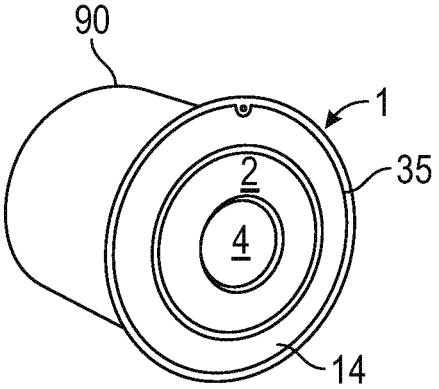

FIGS. 23A-D are schematic side perspective views of a manner for installing an embodiment of the invention in a niche box 90, with FIG. 23A being a view of a niche box 90, FIG. 23B being a view of the light system 1 and cable 32 ready for placement in the niche box 90, FIG. 23C being a view of the light system 1 being attached to the niche box 90 using a tab 46 and then rotated upwards for securing, and FIG. 23D being a view of the light system 1 secured to the niche box 90 with a screw. The niche box 90 is mounted in the solid wall of a pool or spa, often by attachment to the rebar structure of the pool or spa wall during the construction phase of the pool or spa, and sometimes into a hole or passageway drilled into the pool or spa wall after construction. As can be seen in FIG. 23A, the niche box is a cup-like structure having a hollow interior, an upper connecting means and a lower connecting means. The upper connecting means can be a screw hole 36 and the lower connecting means can be a slot 92 for accepting a tab 46. The bottom of the cup-like niche box 90 has a port (not shown) for allowing electrical and/or other utility cabling to pass through. In FIG. 23B, an electrical cable 32 extends from the bottom of the niche box 90 for connecting with the light system 1 to supply power to the light system 1.

FIG. 23C illustrates a method for attaching the light system 1 to the niche box 90. Holding the light system 1 at an angle, a tab 46 or tongue on the flange 35 of the light system 1 is inserted into the lower connecting means slot 92 of the niche box 90. Once the tab 46 or tongue is inserted in to the slot 92, the light system 1 is rotated towards the open end of the niche box 90 so as to cover the opening as shown in FIG. 23D. Once in place covering the opening of the niche box 90, a screw can be inserted through the screw hole 36 in the flange 33 and into the upper connecting means screw hole 36 of the niche box 90, thus securing the light system 1 to the niche box 90. This same manner of attachment can be used to attach the light system 1 directly to a pool or spa wall that has a niche or passage formed therein, without the use of a separate niche box 90. For this, the niche or passageway itself would comprise a slot 46 and a screw hole 36 at the appropriate locations.

Figure 24:
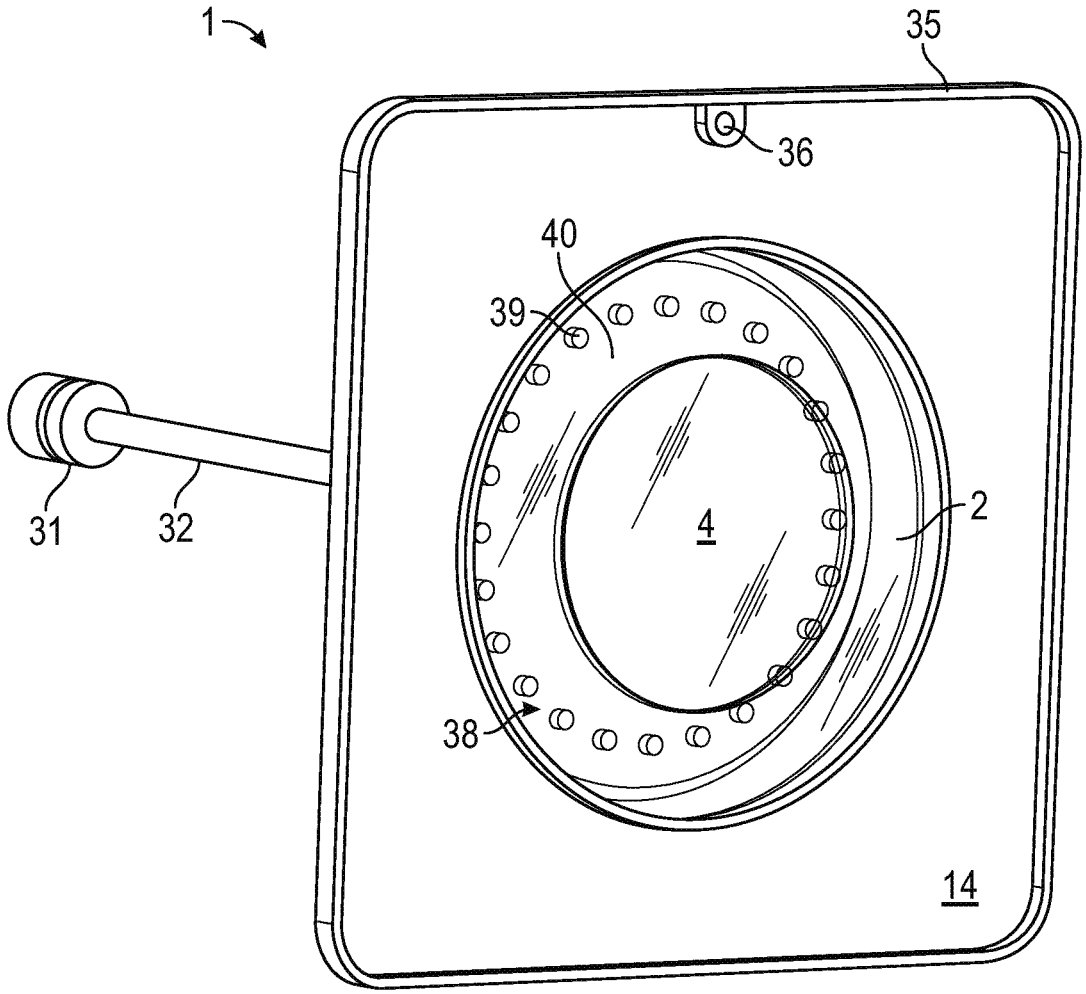
FIG. 24 is a perspective side view of the flanged light system of FIG. 1 having a square flange and a round lens.

FIG. 24 is a perspective side view of the light system 1 of FIG. 1 having a square flange and a round lens. The LED array 39, printed circuit board 40, and internal components for these embodiments remain the same, as this figure is to illustrate that different shapes can be applied to the visible components. However, the LED array 39 and printed circuit board 40 can be made to match any shape of the flange 35 and lens 38.

Figure 25:
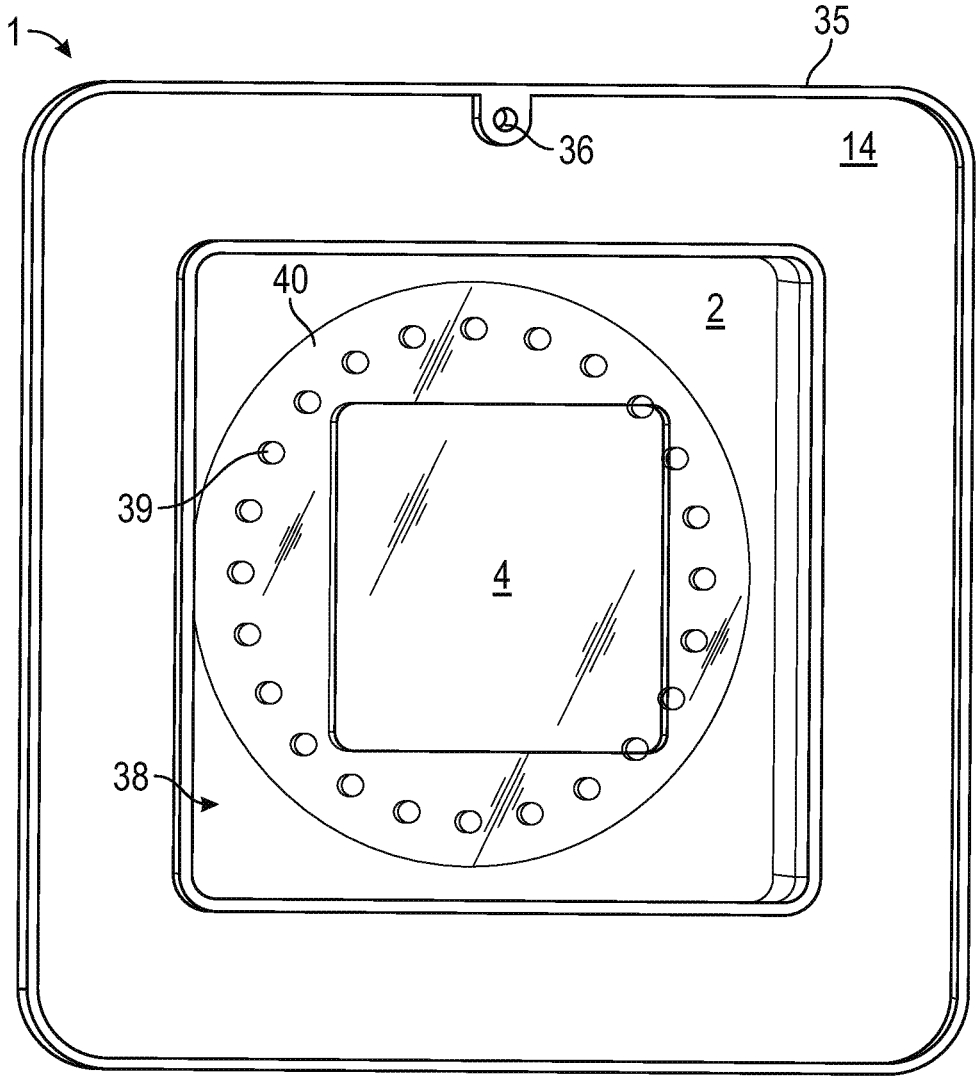
FIG. 25 is a perspective side view of the flanged light system of FIG. 1 having a square flange and a square lens.

FIG. 25 is a perspective side view of the light system of FIG. 1 having a square flange and a square lens. This figure also illustrates that different shapes of the LED array 39 and printed circuit board 40 also can be used. The mechanical fastening features to hold in the aesthetic surface material, the aesthetic surface material itself, or the caps in these embodiments can be structured to fit the now square recesses.

Flangeless Embodiments

The flangeless embodiments of the present invention are generally similar in structure to the flanged embodiments described above, but without the outer decorative flange and appurtenant structures necessary for the flange. As such, the following description of the flangeless embodiments have many similarities to the previous description of the flanged embodiments and will generally track the previous description of the flanged embodiments with the differences highlighted. Also, preferred embodiments of the flangeless light systems can be provided with grooves around the outside of the light and/or lens structure and can be installed in a housing or a niche with the bayonet-style twist-lock structure and system such as shown in FIGS. 18-19.

Figure 26:
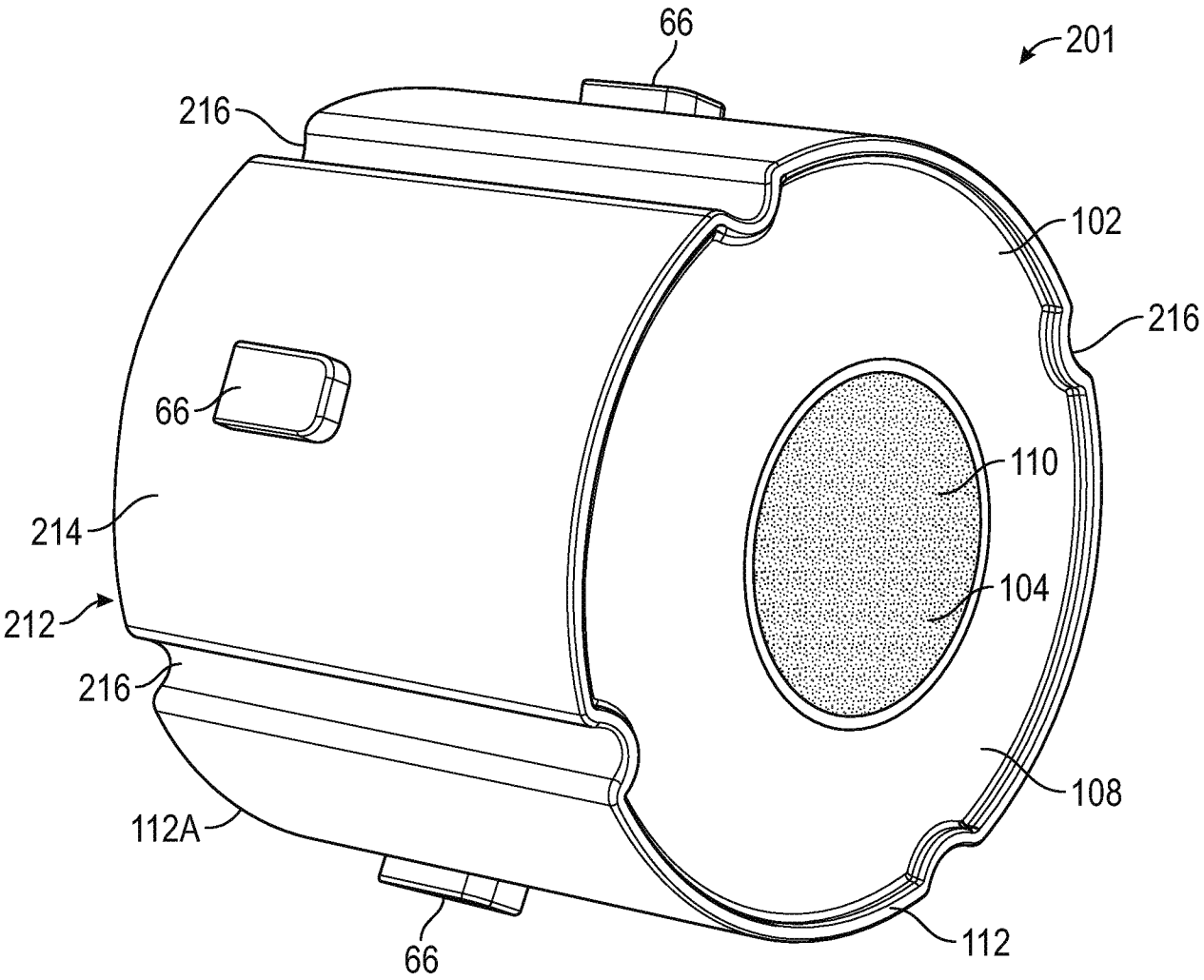
FIG. 26 is a front perspective view of an exemplary embodiment of a flangeless light system according to the present invention for use in a wall-mounted housing, without a separate niche.

FIG. 26 is a front perspective view of an exemplary embodiment of a flangeless light system according to the present invention for use without a separate niche, and preferably installed in a housing, such as a wall-mounted housing in the side or floor of a spa or pool. The light system 201 comprises a base component 212 having a tubular body 214 for mounting within a housing 233 (see FIGS. 34 and 35), which housing 233 is mounted through or within a surrounding mounting surface of a pool or spa shell, floor, liner, or wall, for example (see, e.g., FIG. 22 for a representative housing 33, 233 mounting set up on a spa shell 120), a generally flattened lens 102 at a first end 112 of the body 214, mounting means 216 for assisting in securing the base component 212 within the mounting housing 233 for securing the base component to surrounding mounting surface 16, and a light source(s) (not shown, but contained within base component 212).

This embodiment of the base component 212 is a one-piece component. The base component 212 has the lens 102 attached normal to a first end 112 of the tubular body 214. The first end 112 of the tubular body 214 preferably is initially open, allowing access to the hollow interior of the base component 212, for containing and accessing the light source(s). The lens 102 is formed out of a transparent, semi-transparent, or translucent material capable of transmitting light, and defines at least a central region 104 configured for receiving a "masking", "hiding", filler, or bonding material 110 and a visible region 108 that allows light to pass through the lens 102 and be seen. The lens 102, which is illuminated by the light source(s) effectively forms a translucent ring/halo/band around the central region 104.

The lens 102, in this embodiment, can be a translucent, disk-shaped, Fresnel lens defining a circular shape with a recessed central region 104. The translucent visible region 108 is a concentric band around the recessed central region 104 of the lens 102. The recessed central region 104 may be filled with an aesthetic material to match or compliment the surrounding mounting surface 16 around the light system 201 (see, e.g., FIGS. 3, 5, 7, and 9 for representative mounting situations). The halo-shape of the translucent visible region 108 defines a first concentric band around the central region 104 bull's-eye. Although the term "bull's-eye" is used herein, the light system 201 does not need to be circular, and other shaped "bull's-eyes" are contemplated, such as concentric triangles, rectangles, and other geometric figures.

FIG. 26 also shows a bayonet-style twist lock structure and system. For example, as taught in more detail in connection with FIGS. 34-36, bayonet or mounting surface 66 can cooperate with a separate groove 270, indentation, or cooperating projection on the inner surface of housing 233 whereby light system 201 can be inserted into housing 233 a certain distance and then twisted such that mounting surface 66 cooperates with and/or is twisted out of groove 270, indentation, or cooperating projection to hold light system 201 within housing 233 in a known bayonet-style twist lock system. Alternatively, the cooperation between the mounting assist means 216 can involve simple friction fittings. For example, tubular body 214 may comprise mounting assist means 216 in the form of grooves 218 lengthwise down the side of tubular body 214. Grooves 218 can cooperate with projections (not shown) in housing 233 whereby grooves 218 and projections align light system 201 within niche and can help secure light system 201 within housing 233 by additional friction fit.

Figure 27:
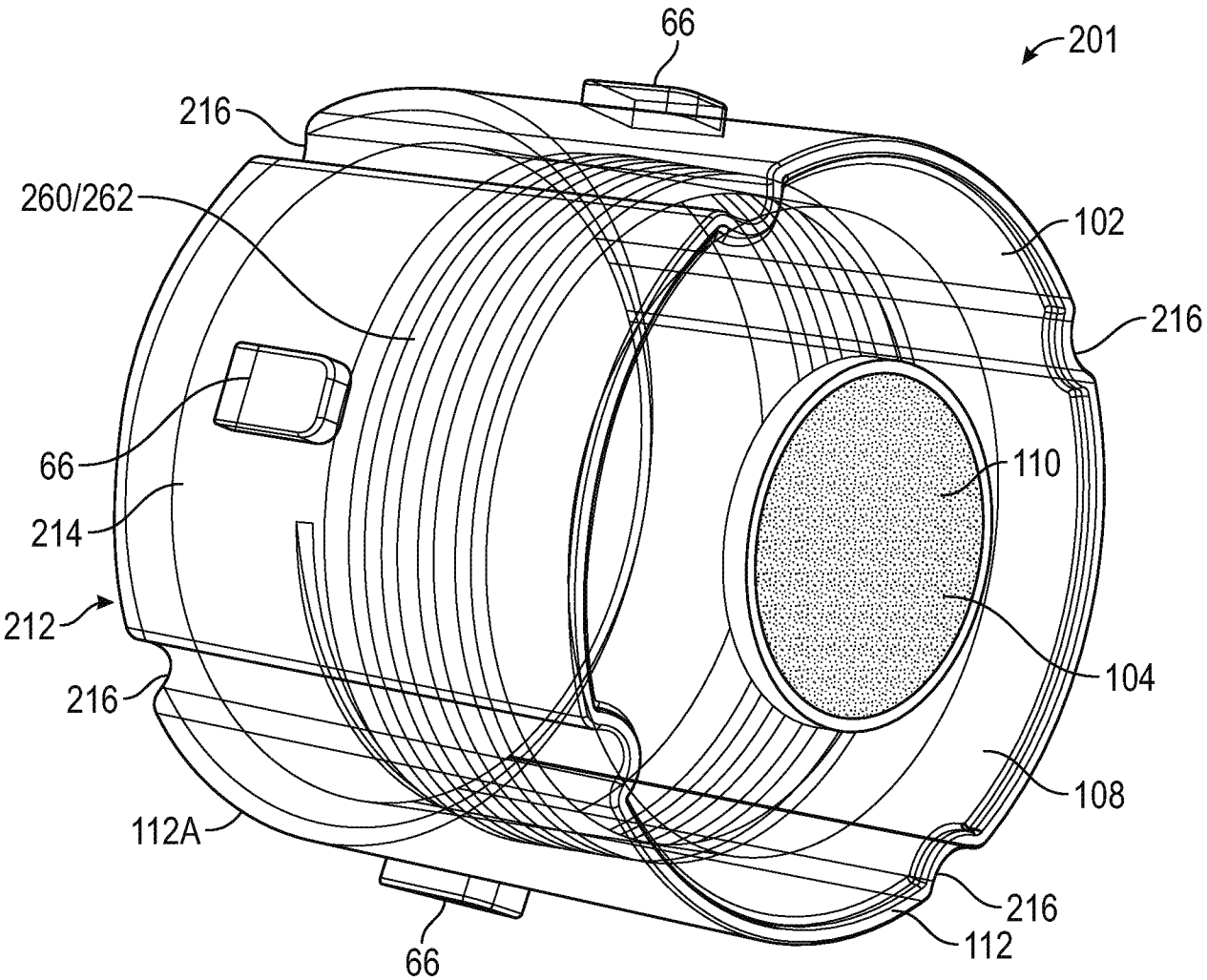
FIG. 27 is a front perspective layered view of the flangeless light system of FIG. 26 for use in a wall-mounted housing, without a separate niche, illustrating additional internal threading attachment details.

FIG. 27 is a front perspective layered view of the flangeless light system of FIG. 26 illustrating additional internal threading attachment details. FIG. 27 can be thought of as an "x-ray view" or a view in which the base component 212 and other structural components of the light system 201 are made from a transparent or translucent material such that the internals of the light system 201 can be seen. As disclosed in additional detail in connection with FIG. 33, at the light array end, tubular light structure 254 has a male thread 260 for cooperating with a female thread 262 on the lens 102 holding component, whereas the component comprising the lens 102 can be screwed onto the tubular light structure 254.

Figure 28:
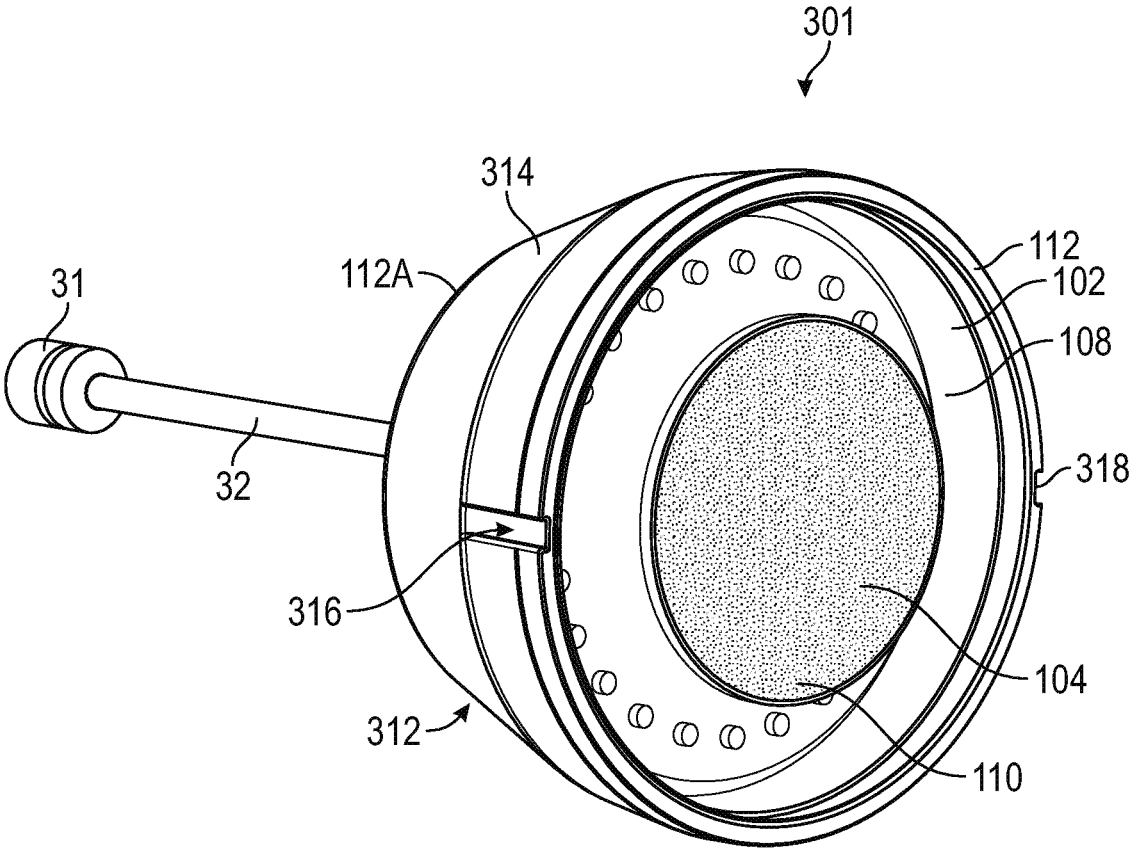
FIG. 28 is a front perspective view of an exemplary embodiment of a flangeless light system according to the present invention for use with a separate niche.

FIG. 28 is a front perspective view of an exemplary embodiment of a flangeless light system 301 according to the present invention for use with a separate niche, such as in the niche box 90 shown in FIGS. 23A-D. The light system 301 is similar to the light system 201 of FIG. 26, but for the differences described herein. The light system 301 comprises a disk-shaped lens 102 mechanically retained by a pool niche 90 (see FIGS. 23A-D). The light system 301 is embedded into the wall/surrounding mounting surface 16, as is understood by a person having ordinary skill in the art. The light system 301 has the halo 108 illuminated, and a light source is activated to illuminate the halo 108. The recessed central region 104 of the lens 102 can be filled with an aesthetic material 110 to match the surrounding mounting surface 16 around the light system 301.

The light system 301 also comprises a base component 312 having a tubular body 314 for mounting within a niche box 90 (see FIGS. 23A-D and 28-29), which niche box 90 is mounted through or within a surrounding mounting surface of a pool or spa shell, floor, liner, or wall, for example (see, e.g., FIGS. 20-21 for a representative niche box 90 mounted within a spa wall 72), a generally flattened lens 102 at a first end 112 of the body 314, mounting means 316 for assisting in securing the base component within the niche box 90, and a light source(s) (not shown, but contained within base component 312). As previously disclosed, the mounting means 316 and system can comprise a bayonet-style twist lock structure and system. For example, bayonet or mounting surface 66 can cooperate with a separate groove (not separately numbered, but similar in placement, structure and function to groove 270), indentation, or cooperating projection on the inner surface of niche box 90 whereby light system 301 can be inserted into niche box 90 a certain distance and then twisted such that mounting surface 66 cooperates with and/or is twisted out of this groove, indentation, or cooperating projection to hold light system 301 within niche box 90 in a known bayonet-style twist lock system. The lower end of this groove can have an exit slot or locking area (not separately numbered, but similar in placement, structure and function to area 272) normal to the direction of this groove to allow bayonet mounting surface 66 to rotate out of this groove and be locked or otherwise secured within this locking area. Alternatively, the cooperation between the mounting assist means 316 can involve simple friction fittings.

The base component 312 has the lens 102 attached normal to a first end 112 of the tubular body 314. The first end 112 of the tubular body 314 preferably is initially open, allowing access to the hollow interior of the base component 312, for containing and accessing the light source(s). The lens 102 is formed out of a transparent, semi-transparent, or translucent material capable of transmitting light, and defines at least a central region 104 configured for receiving a "masking", "hiding", filler, or bonding material 110 and a visible region 108 that allows light to pass through the lens 102 and be seen. The lens 102, which is illuminated by the light source(s) effectively forms a translucent ring/halo/band around the central region 104.

Figure 29:
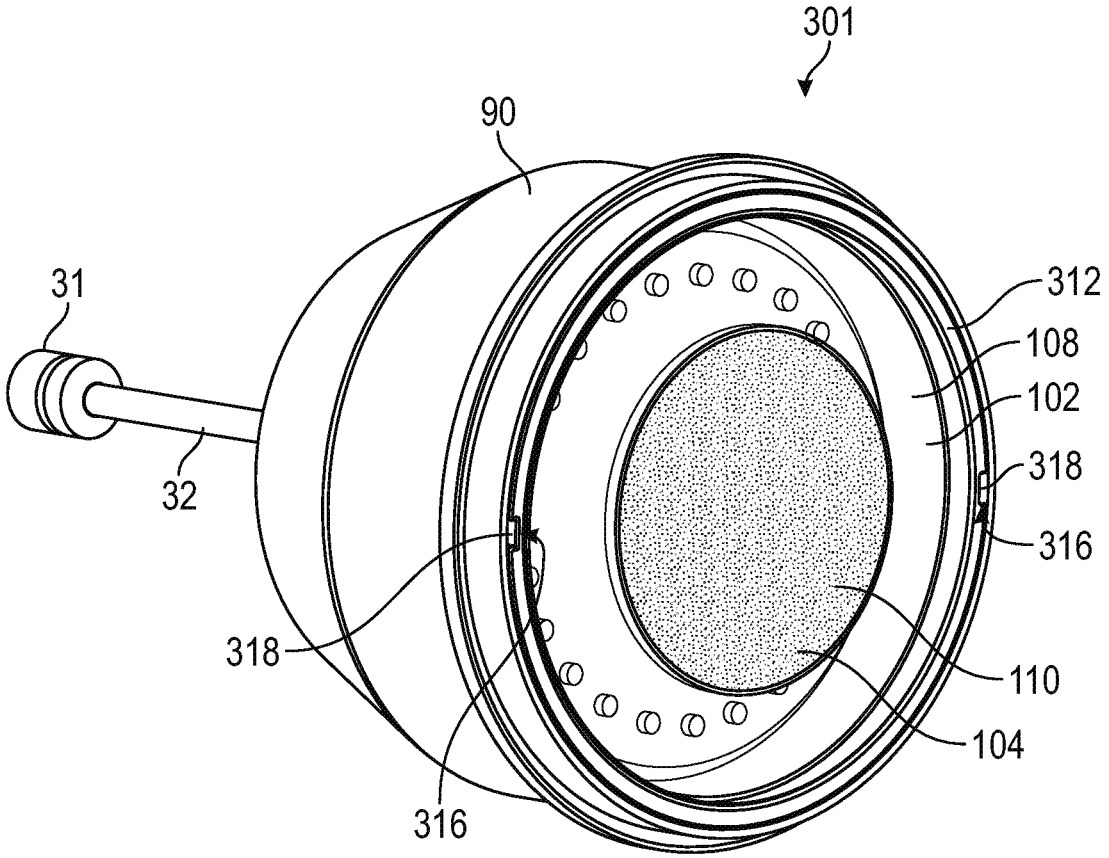
FIG. 29 is a front perspective view of the flangeless light system of FIG. 28 installed within a niche.

FIG. 29 is a front perspective view of the flangeless light system 301 of FIG. 29 installed within a niche box 90. Niche box 90 is a cup-like structure having a hollow interior and retaining bars 318 for cooperating with mounting means 316. The bottom of the cup-like niche box 90 has a port (not shown) for allowing electrical and/or other utility cabling to pass through. An electrical cable 32 typically extends from a second end 112A of the light system 301 for allowing electrical and/or other utility cabling to cooperate with the light system 301. For example, the electrical cable 32 can extend from the light system 301 for connecting the light system 301 to a power supply. In this way the light system 301 can be efficiently and effectively inserted, embedded, installed, or inserted into, or through, the side wall(s) or floor of a spa defining the mounting surface 16, and controlled and/or powered. The lens 102 portion preferably is structured so as to be of a reduced profile, that is, flat, shallow domed, etc., so as to reduce contact with a user or pool equipment.

Figure 30:
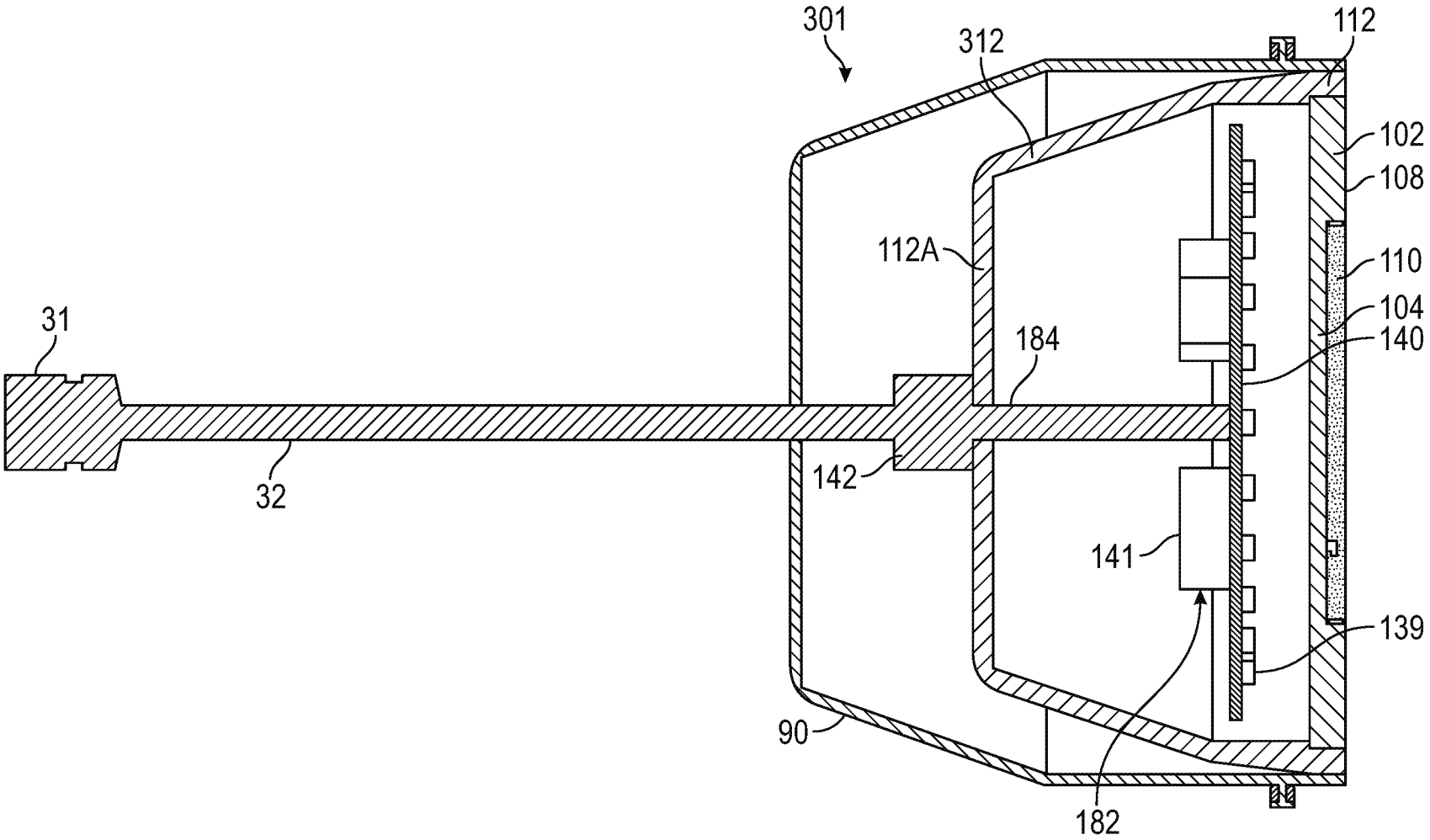
FIG. 30 is a side sectional view of the flangeless light system of FIG. 29 installed within a niche.

FIG. 30 is a side sectional view of the flangeless light system 301 of FIG. 30 installed within a niche box 90 with filler material 110 within the lens recess 104. In this figure, a preferred embodiment of the contour of the lens 102 and of the lighting array and the internal electronics 182 of the light system 301 can be seen in more detail. The lens 102 comprises a central recess 104 for holding the aesthetic surface material 110 or some other aesthetic device, such as a cap (not shown) or other covering. The lens 102 comprises an unobstructed portion 108 for allowing light to pass through and be seen. The lighting array and internal electronics 182 may comprise at least one LED array 139 mounted on a printed circuit board 140 and various known electronic components 141 for providing electrical current to and operating the LED array 139. The LED array 139 and the printed circuit board 140 are arranged within the tubular body 314 such that at least a portion of the LED array 139 can be seen through the lens 102 when the LED array 139 is energized, and can be considered generally on a parallel plane to the lens 102. The LED array 139 may be arranged to be hidden behind the obscured center recess 104, which can provide a more muted lighting effect for accent lighting. Alternatively, the LED array may have directional optics to direct light out around the obscured center recess 104 for a brighter effect. Cable 32 extends through a hole 184 in the base of the tubular housing 312 and is held in place by a known device such as a strain relief fitting 142. Various electronics 182 components can include, for example, heat sinks, transformers, additional printed circuit boards, timers, switches, etc.

In both the nicheless version of the light system 201 and the niche version of the light system 301, the lens 102 preferably is attached normal to the first end 112 of the tubular body 214, 314 of the base component 212, 312. The lens 102 defines a recessed central region 104 formed into, but not through, the material of lens 102, and taking the shape of a bulls-eye from a front-facing perspective. When the recessed central region 104 is filled with the filler material 110, the filler material 110 obfuscates or completely obstructs the illuminated recessed central region 104 of the lens 102. Alternatively, the filler material 110 may be at least in part translucent or patterned to provide for a glowing effect in the central region 104. For example, the filler material 110 also can comprise a mixture of different materials, or include holes, to produce a patterned effect. The filler material 110 may be fashioned to be concave, flat, or convex. A separate decorative cap 24 (see FIG. 4) also may be installed to obfuscate or completely obstruct the illuminated recessed central region 104 of the lens 102, or to allow the light to be redirected. The decorative cap 24 may have a decorative design thereon. The decorative cap 24 also can have holes or a punched design therethrough to allow for light to show through in a desired design or lighting effect. The lens 102 can be of a size typical in the industry, or any appropriate size, as would be known and determined by those of ordinary skill in the art.

In both the nicheless version of the light system 201 and the niche version of the light system 301, and as shown and disclosed in connection with the exemplary embodiment of FIG. 30, the lighting array and internal electronics 182 can be similar and can comprise at least one LED array 139 mounted on at least one printed circuit board 140 and various known electronic components 141 for providing electrical current to and operating the LED array 139. The LED array 139 and the printed circuit board 140 are arranged within the light system 201, 301 such that light emitted from at least a portion of the LED array 139 is emitted through and/or can be seen through the lens 102 when the LED array 139 is energized. The LED array 139 may be arranged to be hidden behind the obscured center recess 104, which can provide a more muted lighting effect for accent lighting. Alternatively, the LED array may have directional optics to direct light out around the obscured center recess 104 for a brighter effect. Various electronics 182 components can include, for example, heat sinks, transformers, additional printed circuit boards, timers, switches, etc.

Also, both the light systems 201, 301 also can comprise a connector 31, preferably a waterproof quick connect/disconnect connector for connecting the light system 201, 301 to an electrical system for the pool or spa and a cable 32 to the lighting array and internal electronics, as disclosed above in connection with FIGS. 10 and 20 regarding connector 31 and cable 32. The connector 31 connects to a mating connector on a longer (e.g., 50-100 foot) cable in the conduit or passage. The longer cable connects to the electrical system for powering the pool or spa, including the light system 201, 301. The connector 31 allows for the light system 201, 301 to be replaced without having to pull the longer 50-100 foot cable out of the conduit or passage and fishing in a new 50-100 foot cable with the new replacement light system 201, 301. Replacing the longer cable can be difficult and the present invention helps in avoiding such a need for replacing the longer cable.

Figure 31:
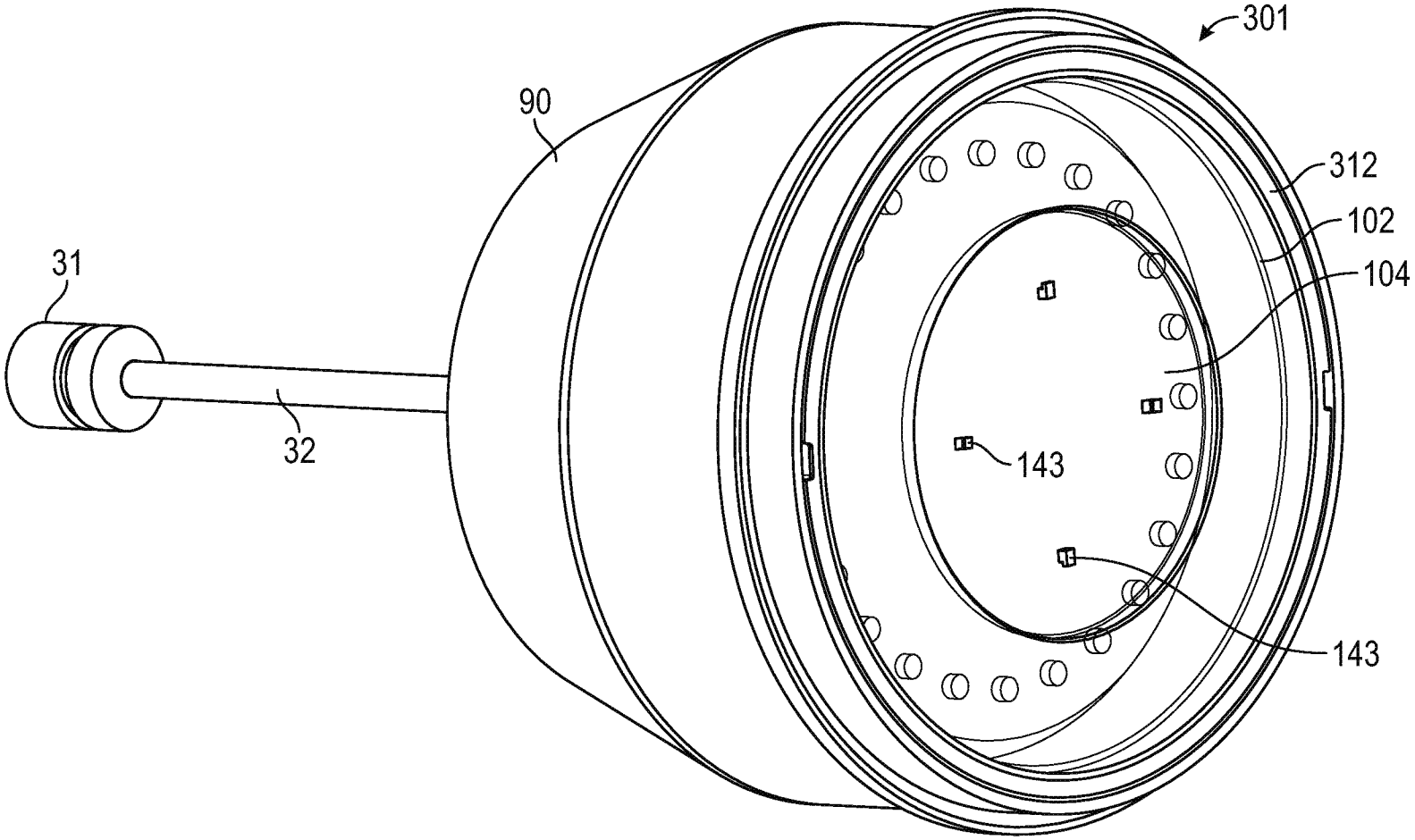
FIG. 31 is a front perspective view of the flangeless light system of FIG. 28 installed within a niche without any filler material in the lens recess.

FIG. 31 is a front perspective view of the flangeless light system 301 of FIG. 28 installed within a niche box 90 without any filler material 110 in the lens recess 104. FIG. 31 illustrates the lens 102 of the light system 301 of FIG. 28 without the aesthetic surface material 137 and showing optional features to mechanically hold the aesthetic surface material 137. Such optional features are shown in the form of tabs 143 to which the aesthetic surface material 137 can secure as the aesthetic surface material 137 dries during installation. The structure of lens 102 for light system 201 can be similar to that shown in FIG. 31, namely with tabs 143 to hold aesthetic surface material 137 within lens recess 104.

FIG. 31 also shows the cooperation between the mounting means 316, in a manner similar to that shown in FIG. 29. In one embodiment, the mounting means 316 can be a bayonet-style twist lock structure and system as disclosed above. For example, as taught herein, bayonet or mounting surface 66 can cooperate with a separate groove, indentation, or cooperating projection on the inner surface of niche box 90 whereby light system 301 can be inserted into niche box 90 a certain distance and then twisted such that mounting surface 66 cooperates with groove, indentation, or cooperating projection to hold light system 301 within niche box 90 in a known bayonet-style twist lock system. The lower end of groove can have an exit slot or locking area normal to the direction of groove to allow bayonet mounting surface 66 to rotate out of groove and be locked or otherwise secured within a locking area. In another embodiment, the cooperation between the mounting assist means 316 can involve simple friction fittings. For example, tubular body 314 may comprise mounting assist means 316 in the form of grooves 318 and projections (not shown), with grooves 318 extending lengthwise down the side of tubular body 314. Grooves 318 can cooperate with projections in niche box 90 whereby grooves 318 and projections align light system 301 within niche box 90 and can help secure light system 301 within niche box 90 by additional friction fit.

In an alternative embodiment of the niche version of the light system 301, the flangeless light system 301 shown in FIGS. 28-31 can be mounted in a niche box 90 in a manner similar to that shown in connection with FIGS. 23A-D, which are schematic side perspective views of a manner for installing an embodiment of the invention in a niche box 90. In the embodiments shown in FIGS. 28-31, however, the tubular body 314 can have mounting means 316 comprising mounting surfaces 66 (bayonets) and/or grooves 318 and/or projections for assisting in securing the base component within the niche box 90, with niche box 90 optionally having retaining bars 318 for cooperating with mounting means 316 on tubular body 314, or vice versa, rather than a screw mounting/retaining system. The niche box 90 is mounted in the solid wall of a pool or spa, often by attachment to the rebar structure of the pool or spa wall during the construction phase of the pool or spa, and sometimes into a hole or passageway drilled into the pool or spa wall after construction.

Thus, in the alternative embodiments taught immediately above, the niche box 90 still is a cup-like structure having a hollow interior; however, the light system 301 is retained within niche box 90 via cooperation between mounting surfaces 66 and/or grooves and/or retaining bars 318. As disclosed herein, mounting means 316 can be one or more simple groove along the outer surface of tubular body 314 extending lengthwise from or proximal to first end 112 to or proximal to second end 112A of tubular body 314. Similarly, retaining bars 318 can be one or more simple protrusions along the inner surface of niche box 90 structured to cooperate with mounting means 316 so as to provide a friction fit. Cooperating bumps, ridges, indentions, slots, or other securing means (not shown) can be included on either or both of mounting means 316, namely, retaining bars 318 and grooves, which securing means may assist in retaining light system 301 within niche box 90. The bottom of the cup-like niche box 90 still may have a port (not shown) for allowing electrical and/or other utility cabling to pass through. For example, an electrical cable 32 can extend from the bottom of the niche box 90 for connecting the light system 301 to supply power to the light system 301.

The niche version of the light system 301 also can be mounted in a niche in a pool or spa wall for holding a niche version of the light system 301 of the present invention, in a manner similar to that disclosed in connection with FIGS. 20-21. Niche 70 is pre-formed in the wall 72 during the original installation of the pool or spa, or can be formed afterwards. Niche 70 can be any size and shape, and often is of a standard size and shape for holding light features or other features. Niche 70 often has a passageway 74 at the rear of the niche 70 and extending out of the pool or spa structure for allowing electrical wiring 76 to pass into the niche 70. The spa light system 301 can be inserted into and secured within the niche 70 as disclosed previously, with cable 32 connected to wiring 76 via connector 31. Thus, spa light system 201 can be removably and replaceably inserted into niche 70. Alternatively, a niche box 90 also can be inserted into niche 70 if desirable.

Figure 32:
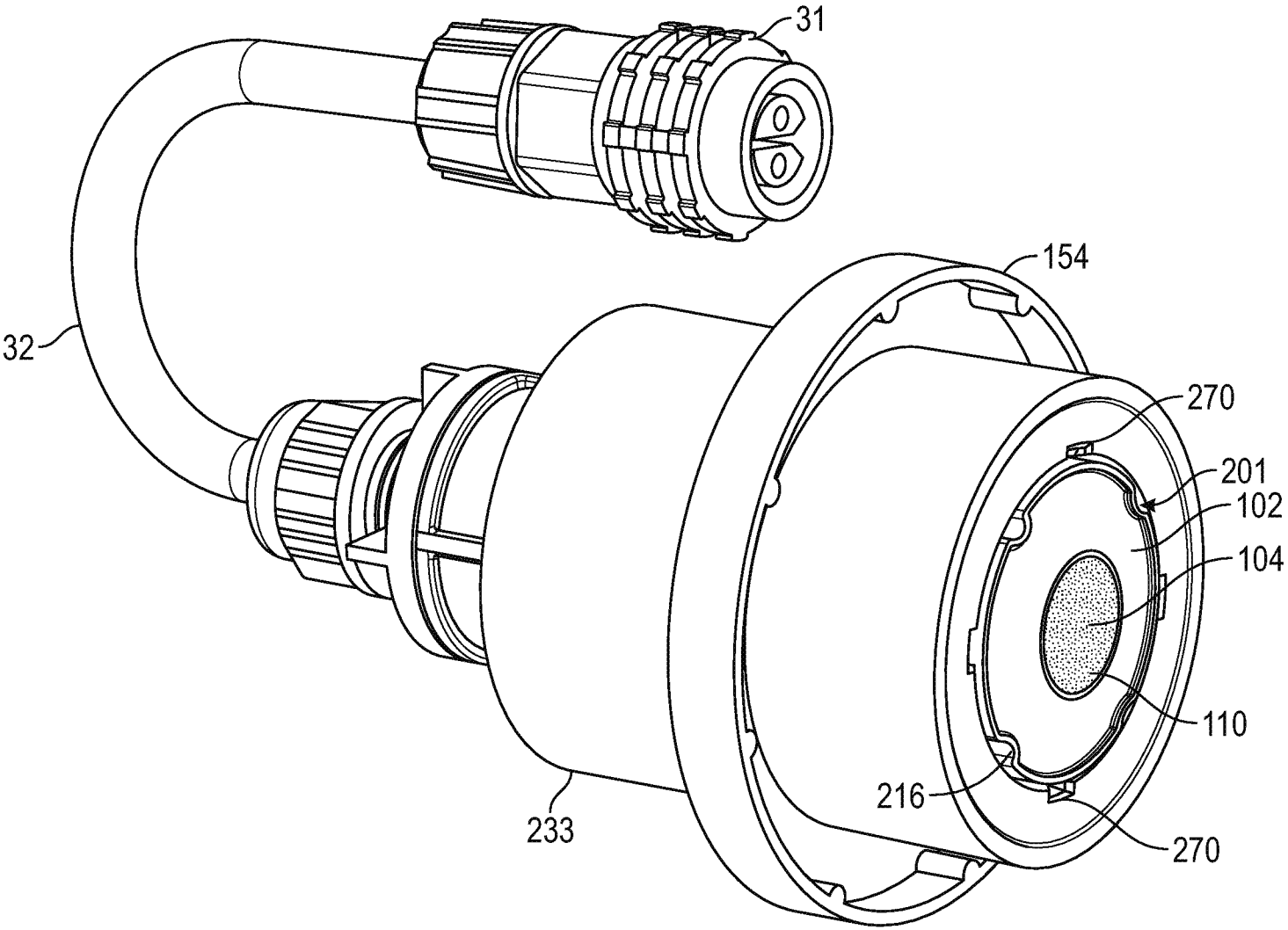
FIG. 32 is a front perspective view of the flangeless light system of FIG. 26 installed within a spa wall mounting structure.

FIG. 32 is a perspective side view of a nicheless light system 201 suitable for use in the present invention. This nicheless light system 201 typically is for mounting directly in a gunite or concrete wall of a pool or spa, and not in a niche. More specifically, when the pool or spa is manufactured, a light housing 233 similar in structure and function to the light housing 33 shown in FIGS. 16-17, is attached to rebar and the wet or unhardened gunite or concrete is applied around the light housing 233, which remains as a permanent feature when the gunite or concrete sets and hardens. The nicheless light system 201 comprises similar or analogous components as the light system 1 shown in FIG. 10, such as connector 31, cable 32, lighting LED array 139 and internal electronics 182, a light housing 233, and a lens 102 with at least one recess 104 for containing an aesthetic surface material 110. The light housing 233 further comprises a water stop 154 extending radially outwardly from a generally central location on the light housing 233. The water stop 154 both helps retain the light housing 233 in the gunite or concrete and also provides a barrier or stop helping to prevent water seeping between the gunite or concrete and the outer surface of the light housing 233 from seeping or leaking out of the pool or spa.

Figure 33:
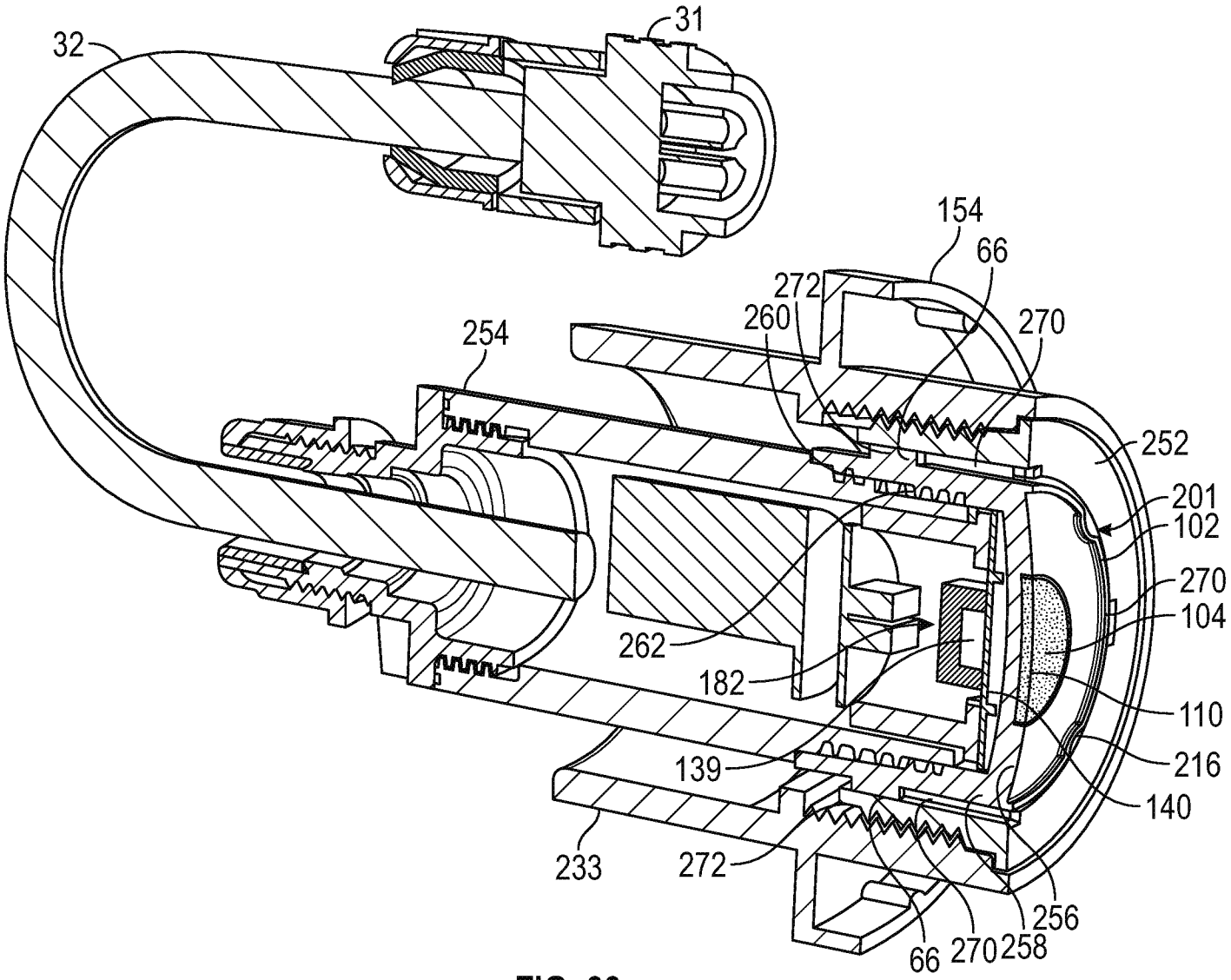
FIG. 33 is a front perspective sectional view of the flangeless light system of FIG. 32 with additional detail regarding the spa wall mounting structure and the connections of the light system to the spa electrical system.

FIG. 33 is a perspective side sectional view of the nicheless light system 201 of FIG. 32. Generally, the internal arrangement of components for the nicheless light system 201 also is similar or analogous to the internal arrangement of components for the light system 1 of FIG. 10. However, an exemplary embodiment of the nicheless light system 201 can comprise three primary components: light housing 233 component, lens 102 and lens mounting component 252, and tubular light structure 254. Tubular light structure 254 contains the light array and electronic components, such as the LEDs 139 and printed circuit board(s) 140 at one end and the cable 32 extending out the opposite end. At the light array end, tubular light structure 254 has a male thread 260 for cooperating with a female thread 262 on the lens 102. In this manner, tubular light structure 254 can be releasably secured to the lens 102 to create a water-tight or water-proof structure to protect the LEDs 39, printed circuit board 140, and the other electronic components located within the tubular lighting structure 254. As one of ordinary skill in the art will understand, the tubular light structure 254 and the threaded region of the lens 102 can be circular in cross-section, with the light housing 233 and lens 102 itself being different geometrical configurations. In this manner, a common tubular light structure 254 can be used in combination with various different shaped light housings 233 and lenses 102.

FIG. 33 also illustrates an embodiment in which the mounting means 316 can be a bayonet-style twist lock structure and system as disclosed above. For example, bayonet or mounting surface 66 can cooperate with a separate groove 270, indentation, or cooperating projection on the inner surface of housing 233 whereby light system 201 can be inserted into housing 233 a certain distance and then twisted such that mounting surface 66 cooperates with groove 270, indentation, or cooperating projection to hold light system 201 within housing 233 in a known bayonet-style twist lock system. The lower end of groove 270 can have an exit slot or area 272 normal to the direction of groove 270 to allow bayonet mounting surface 66 to rotate out of groove 270 and be locked or otherwise secured within area 272. Two or more bayonet mounting surfaces 66 and cooperating grooves 270 are preferred, with the embodiments shown herein having four of each of bayonet mounting surfaces 66 and cooperating grooves 270.

Similar to as disclosed in connection with FIGS. 16-17, light housing 233 shown in FIGS. 32-33 is a generally hollow tubular component mounted within the gunite or concrete wall. Light housing 233 may have an internal female thread on the pool or spa end of the light housing 233 for cooperating with a male thread on or attached to the lens 102, or on a lens mounting component 252 (cf. FIG. 17 and the description thereof). In this manner, lens 102, along with tubular light structure 254, can be releasably secured to the light housing 233 and thus mounted in the pool or spa wall. Thus, tubular light structure 254 can be screw-mounted to lens 102, and the combination lens 102 and tubular light structure 254 can be screw-mounted to light housing 233, or snapped into the light housing 233 (cf. FIG. 17 and the description thereof), or even welded or adhesively affixed to the light housing 233 for a more permanent manner of attachment. The releasable configurations result in the ability to replace the lens 102 should the lens 102 break or if a new, different lens 102 is desired, and to replace the light array and electronic components should either of them fail. Alternatively, any or all of the components can be permanently attached to each other by, for example, adhesives or welding.

Also similar to the embodiment shown in FIGS. 16-17, lens 102 further comprises a mounting cylinder 258 extending perpendicular from a back side of the lens disk 256, namely the side of the lens disk 256 that does not face into the interior of the pool or spa. Depending on the shape and structure of the pool or spa, or of the lens 102, mounting cylinder 258 can extend at various angles form the lens disk 256, but preferably extends at an angle of 45-90 degrees, and more preferably an angle of 60-90 degrees. Mounting cylinder 258 comprises an internal female thread for cooperating with the external male thread of tubular light housing 254 as previously disclosed.

Also in the embodiments shown in FIGS. 32-33, mounting cylinder 258 further may comprise a means for mounting the lens 102 onto the light housing 233, which means for mounting comprises external mounting surface 66 for attaching to a lens mounting component 252, also shown in FIG. 26. The lens mounting component 252 is a sleeve-like structure that fits within housing 233 and comprises groove 270 and area 272 for cooperating with mounting surface 66, such as using a bayonet or tab lock device, as is known in the art. Lens mounting component 252 can comprise a male thread on the external surface of the sleeve-like structure for attachment to the inner surface of housing 233, and groove 270 and area 272 features on the internal surface of the sleeve-like structure for cooperating with mounting surface 66. In this embodiment, the lens mounting component 252 screws into the light housing 233, and the lens 102 with the tubular structure 254 attached thereto is snapped into the lens mounting component 252. In this manner, tubular light structure 254 can be releasably secured to the lens 102 to create a water-tight or water-proof structure to protect the LEDs 139, printed circuit board 140, and the other electronic components located within the tubular lighting structure 254. The external mounting surface 66 of the mounting cylinder 258 is pushed down into groove 270 and twisted so that mounting surface 66 cooperates with area 272 to secure light system 201 within housing.

Alternatively, groove 270 can have tabs or bayonet features, which undergo plastic or elastic deformation, such that mounting surface 66 may be pressed or pushed into groove and pass completely by the tabs or bayonet features, at which point the tabs or bayonet features snap back and cooperate with mounting surface 66 so as to hold the mounting cylinder 258 within the lens mounting component 252. In this manner, area 272 is not necessary as light system 201 does not need to be rotated. Using such tabs or bayonet features to cooperate with mounting surface 66 can result in a more permanent mount for light system 201 as it may be more difficult to pull (remove) light system 201 from within lens mounting component 252.

Lens mounting component 252 may have an external male thread for cooperating with the internal female thread of light housing 233 for releasably securing lens 102 and tubular light structure 254 to light housing 233. Alternatively, instead of external mounting surface 66, mounting cylinder 258 can comprise an external male thread directly on the outer surface of mounting cylinder 258 for cooperating directly with the internal female thread of light housing 233. The lens mounting component 252 can be a part of a faceplate whereby a faceplate can be used that comprises the lens mounting component 252 as a back part, extending normal or at an angle from the faceplate, so that the faceplate, as a separate part from the lens 102, can screw into the light housing 233, and the lens 102 can tab- or bayonet-mount into the faceplate. In this manner, the faceplate can cover and hide preexisting spaces, components, or features.

After the light system 201, 301 is mounted in the pool or spa wall and the lens 102 is attached to or located at the desired place, the lens 102 will contain aesthetic surface material 110, 137 identical to or complimentary with the pool or spa wall and therefore the lens 102 will blend in with the pool or spa wall, creating a pleasing aesthetic look. When the light system 201, 301 is energized, light will be emitted from the lens 102 in the areas not covered by the aesthetic surface material 110, 137 and create an aesthetically pleasing light display. Also, the aesthetic surface material 110, 137 may at least in part be translucent to create a glowing light effect.

Figure 34:
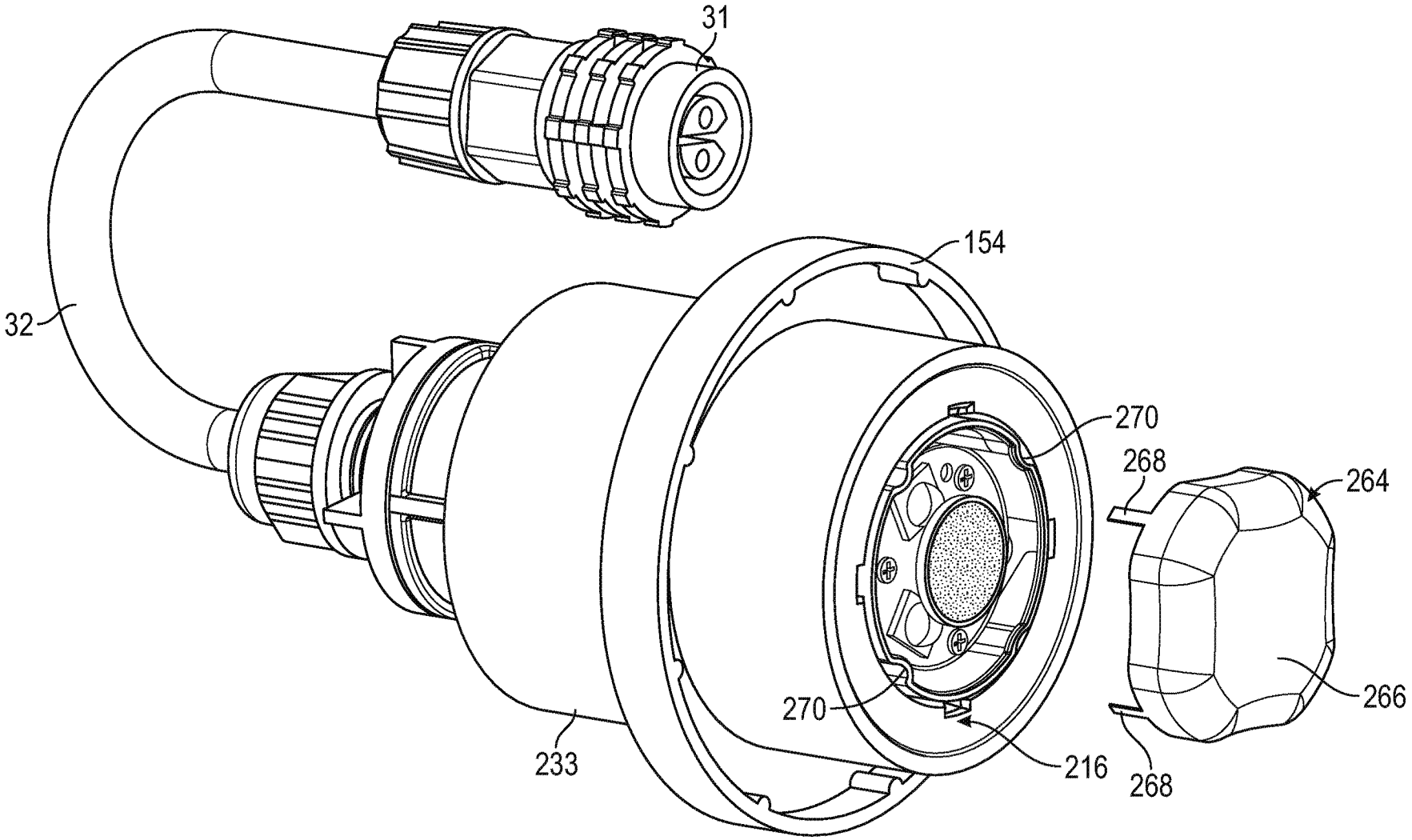
FIG. 34 is a front perspective view of the flangeless light system of FIG. 32 with additional detail showing a tool for inserting and removing the light system from a housing, with the tool ready for insertion.

FIG. 34 is a front perspective view of the flangeless light system 201 of FIG. 32 with additional detail showing a tool 264 for inserting and removing the light system 201 from a housing 233, with tool 264 ready for insertion into mounting assist means 216, which in this embodiment are tool insertion slots 266. Tool 264 can be a device having a handle portion 266 and prongs 268 extending normal to handle portion 266. Tool 264 also may comprise additional raised and/or recessed features to attach a socket wrench, screw driver, or other device to assist with the rotation of tool 264 and light system 201.

Figure 35:
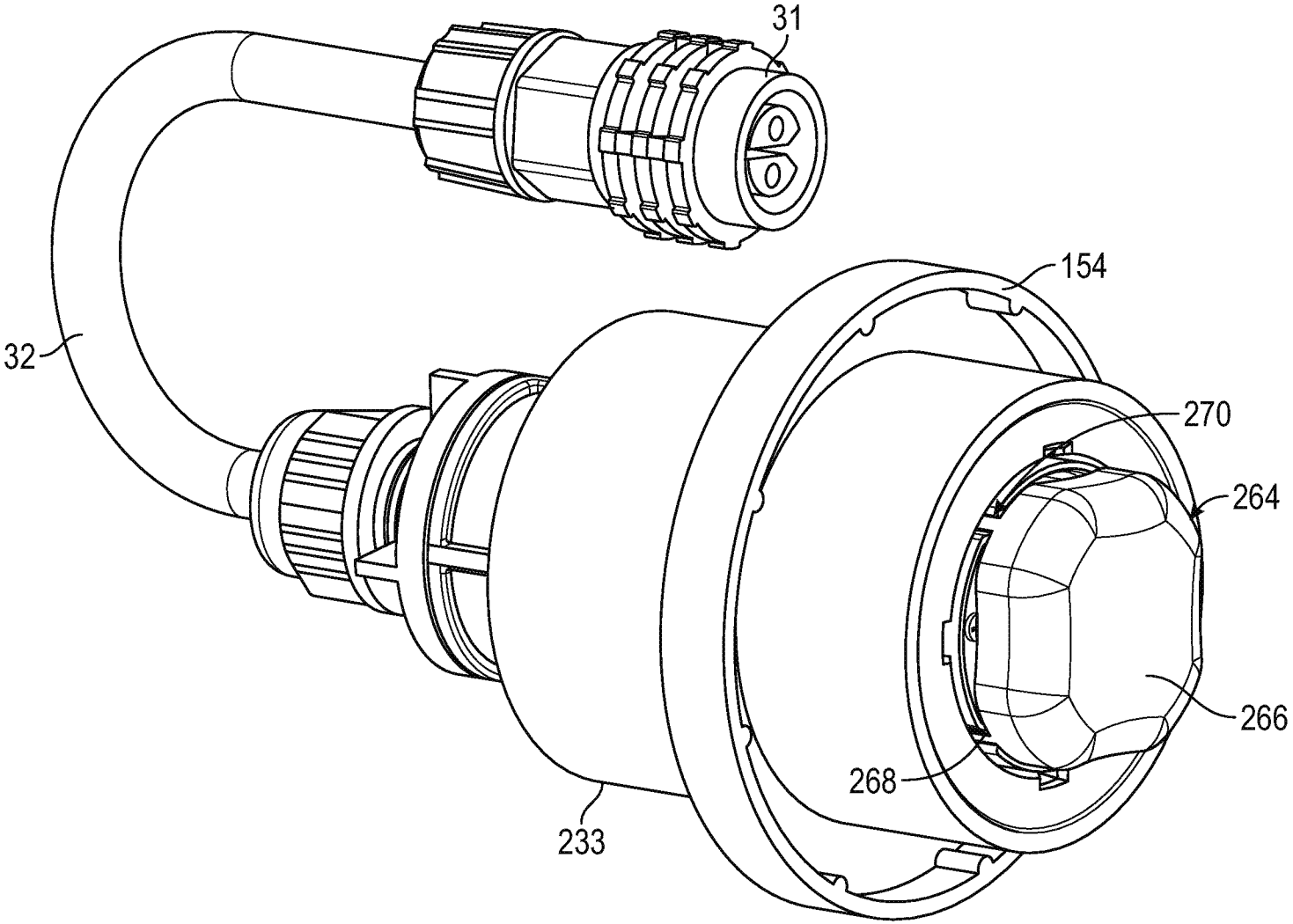
FIG. 35 is a front perspective view of the flangeless light system of FIG. 32 with additional detail showing a tool for inserting and removing the light system from a housing, with the tool inserted.

FIG. 35 is a front perspective view of the flangeless light system 201 of FIG. 32 with additional detail showing tool 264 for inserting and removing the light system 201 from a housing 233, with tool 264 inserted. Prongs 268 are inserted into grooves 270 whereby prongs 268 can engage with the sides of grooves 270 such that when tool 264 is rotated, light system 201 is rotated within housing 233. In this manner, bayonet mounting surface 66 can engage with or disengage with groove 270 and/or area 272, as can be seen in FIG. 33, for locking and/or unlocking light system 201 within housing 233.

Figure 36:
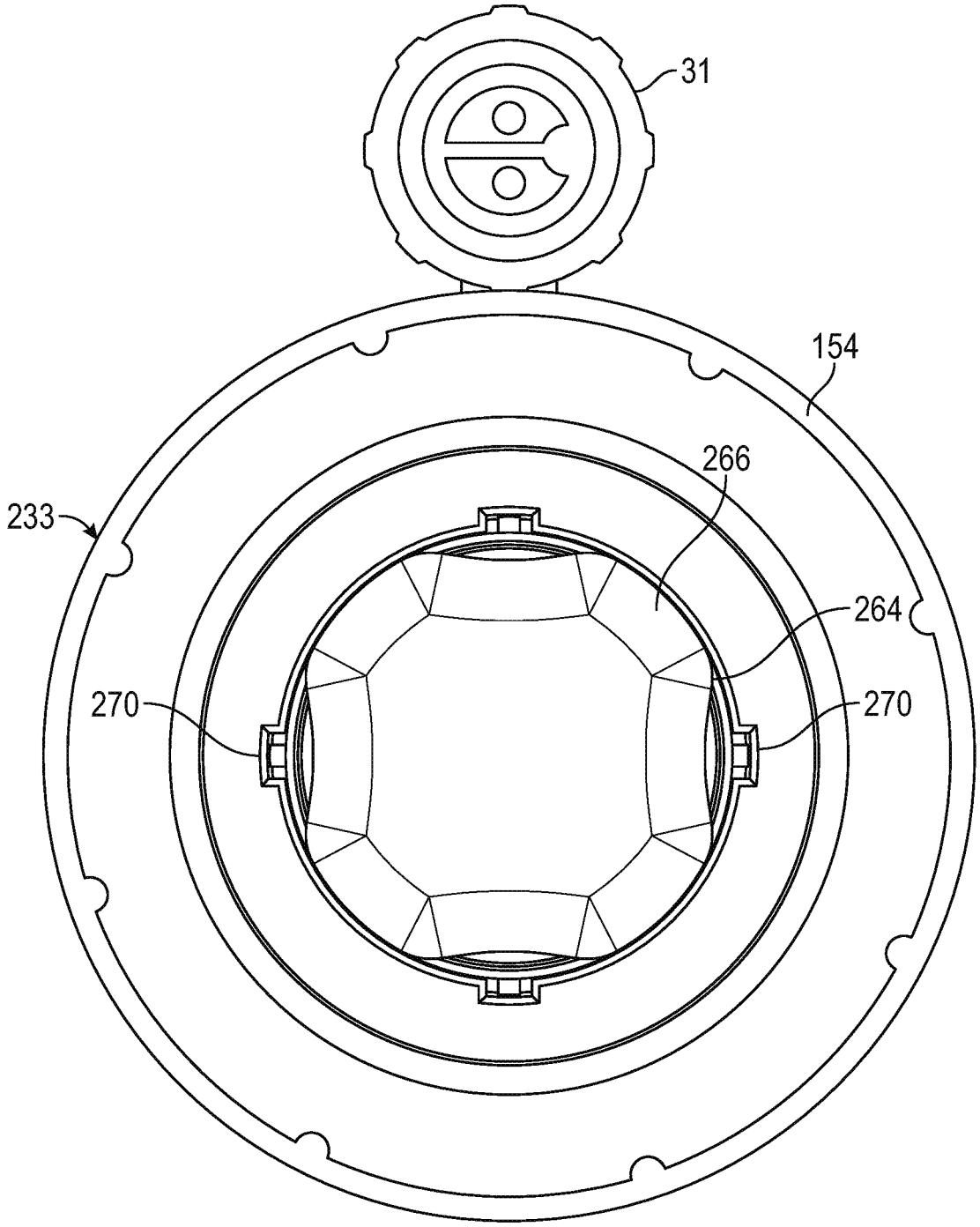
FIG. 36 is a front view of the flangeless light system of FIG. 32 with additional detail showing a tool for inserting and removing the light system from a housing, with the tool inserted.

FIG. 36 is a front view of the flangeless light system 201 of FIG. 32 with additional detail showing tool 264 inserted for locking and/or unlocking and/or removing light system 201 from housing 233. Tool 264 can be any size or shape, so long as tool 264 comprises at least one prong 268 for insertion into at least one groove 270.

Figure 37:
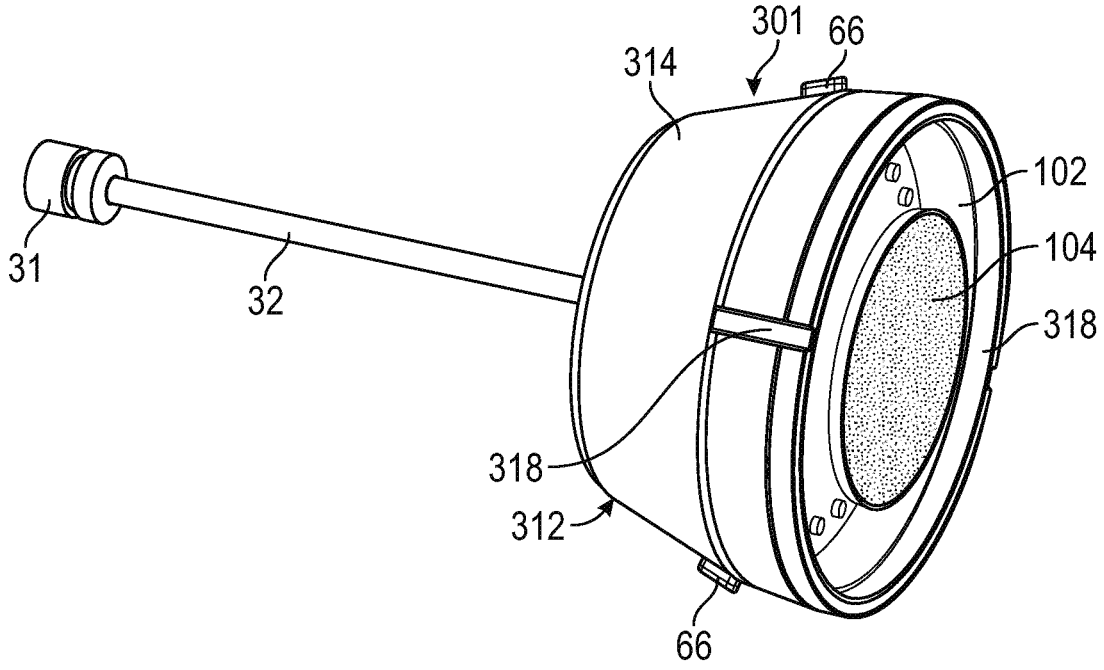
FIG. 37 is a front perspective view of the flangeless light system of FIG. 28 with additional detail showing bayonet projections as mounting means.

FIG. 37 is a front perspective view of the flangeless light system 301 of FIG. 28 with additional detail showing bayonet projections as mounting surfaces 66. This embodiment of light system 301 is suitable for mounting within a niche box 90.

Figure 38:
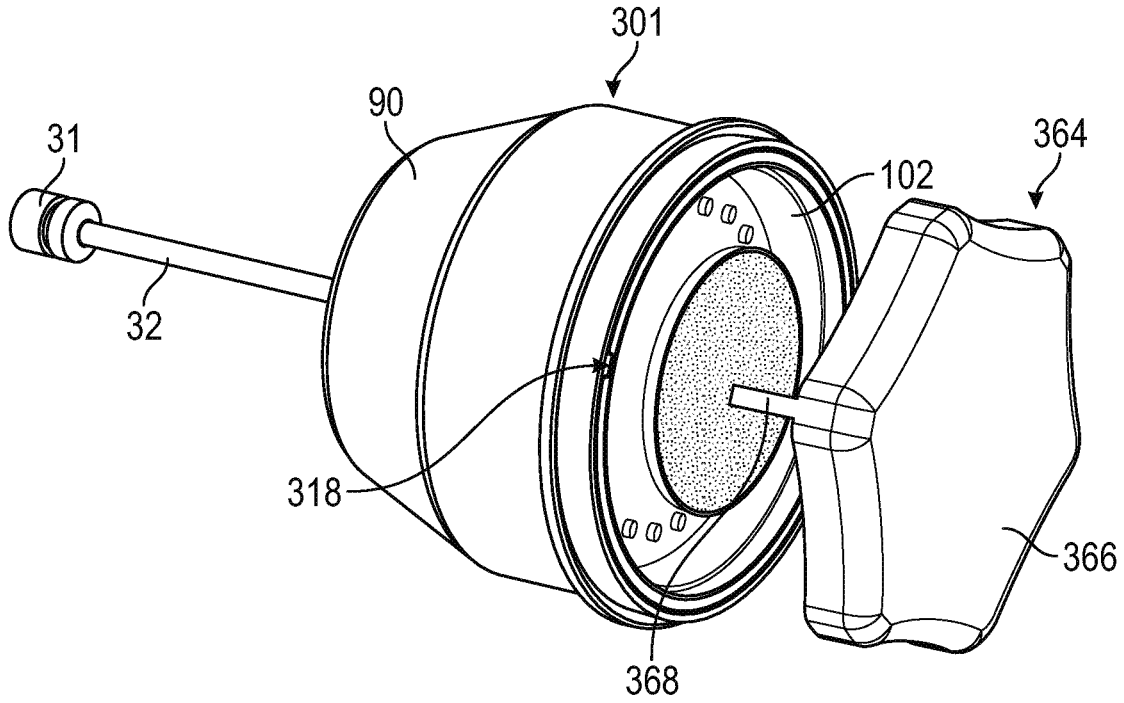
FIG. 38 is a front perspective view of the flangeless light system of FIG. 28 with additional detail showing a tool for inserting and removing the light system from a niche box, with the tool ready for insertion.

FIG. 38 is a front perspective view of the flangeless light system 301 of FIG. 37 with additional detail showing a tool 364 for inserting and removing the light system 301 from a niche box 90, with tool 364 ready for insertion into mounting assist means 316, which in this embodiment are grooves 318. Tool 364 can be a device having a handle portion 366 and prongs 368 extending normal to handle portion 366.

Figure 39:
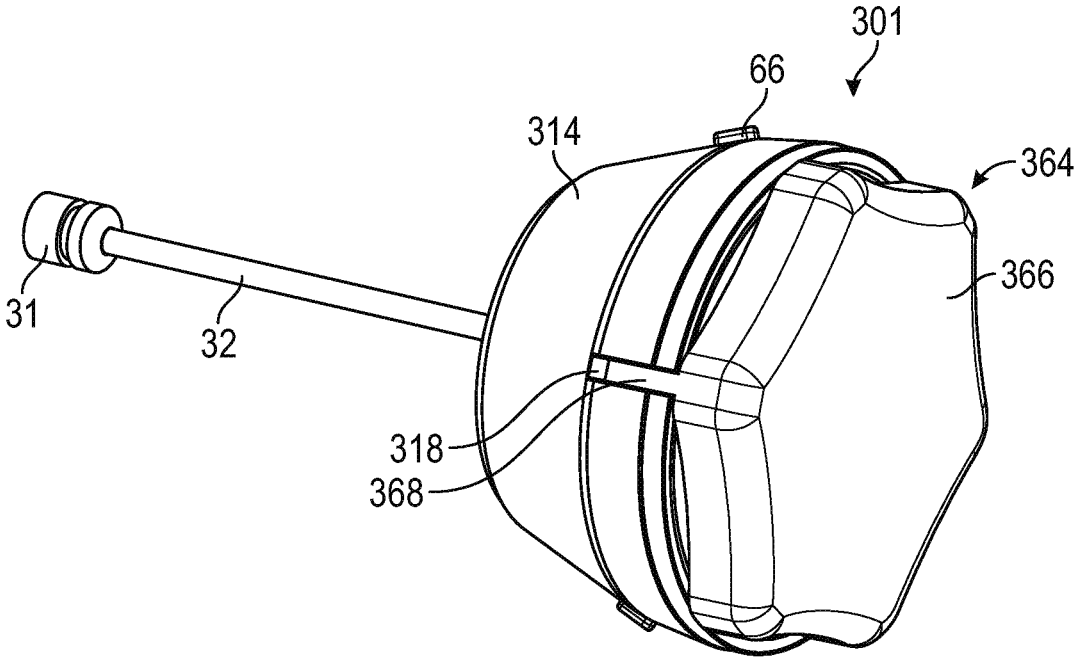
FIG. 39 is a front perspective view of the flangeless light system of FIG. 28 with additional detail showing a tool for inserting and removing the light system from a niche box, with the tool inserted.

FIG. 39 is a front perspective view of the flangeless light system 301 of FIG. 37 with additional detail showing tool 364 for inserting and removing the light system 301 from a niche box 90, with tool 364 inserted. Prongs 368 are inserted into grooves 318 whereby prongs 368 can engage with the sides of grooves 318 such that when tool 364 is rotated, light system 301 is rotated within niche box 90. In this manner, bayonet mounting surface 66 can engage with or disengage with groove 318 and/or a locking area, in a manner similar to that shown in FIG. 33, for locking and/or unlocking light system 301 within niche box 90.

Figure 40:
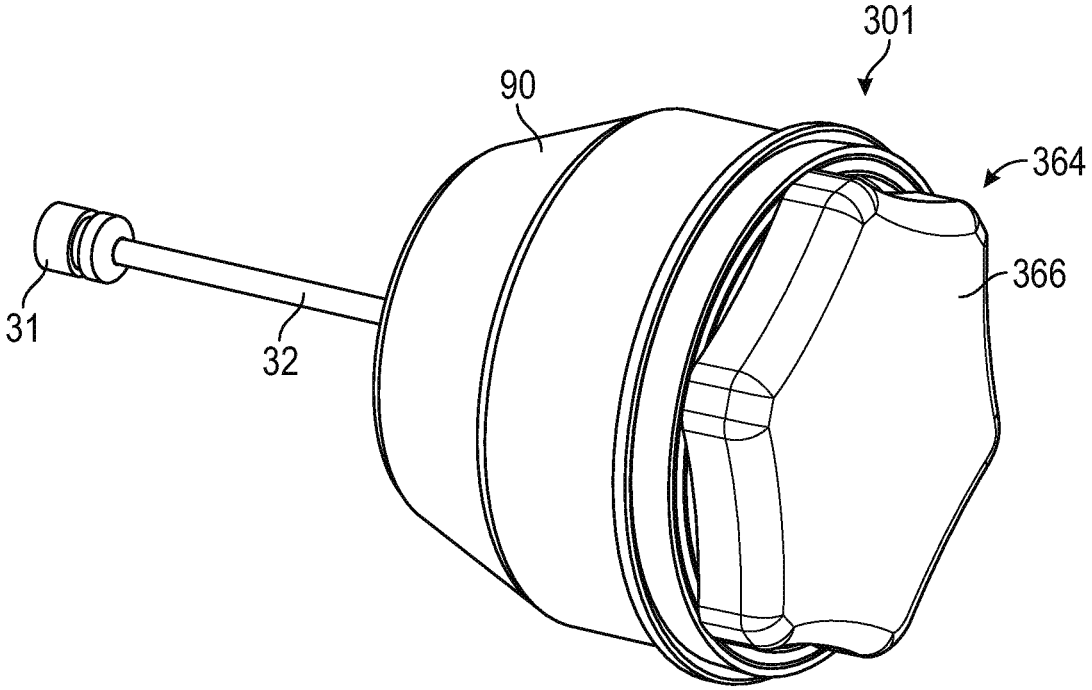
FIG. 40 is a front perspective view of the flangeless light system of FIG. 28 with additional detail showing a tool for inserting and removing the light system from a niche box, with the tool inserted and the light system in a niche box.

FIG. 40 is a front perspective view of the flangeless light system 301 of FIG. 37 with additional detail showing tool 364 for inserting and removing the light system 301 from a niche box 90, with tool 364 inserted and the light system 301 in a niche box 90. Prongs 368 are inserted into grooves 318 whereby prongs 368 can engage with the sides of grooves 318 such that when tool 364 is rotated, light system 301 is rotated within niche box 90. In this manner, bayonet mounting surface 66 can engage with or disengage with groove 318 and/or a locking area, in a manner similar to that shown in FIG. 33, for locking and/or unlocking light system 301 within niche box 90.

Figure 41:
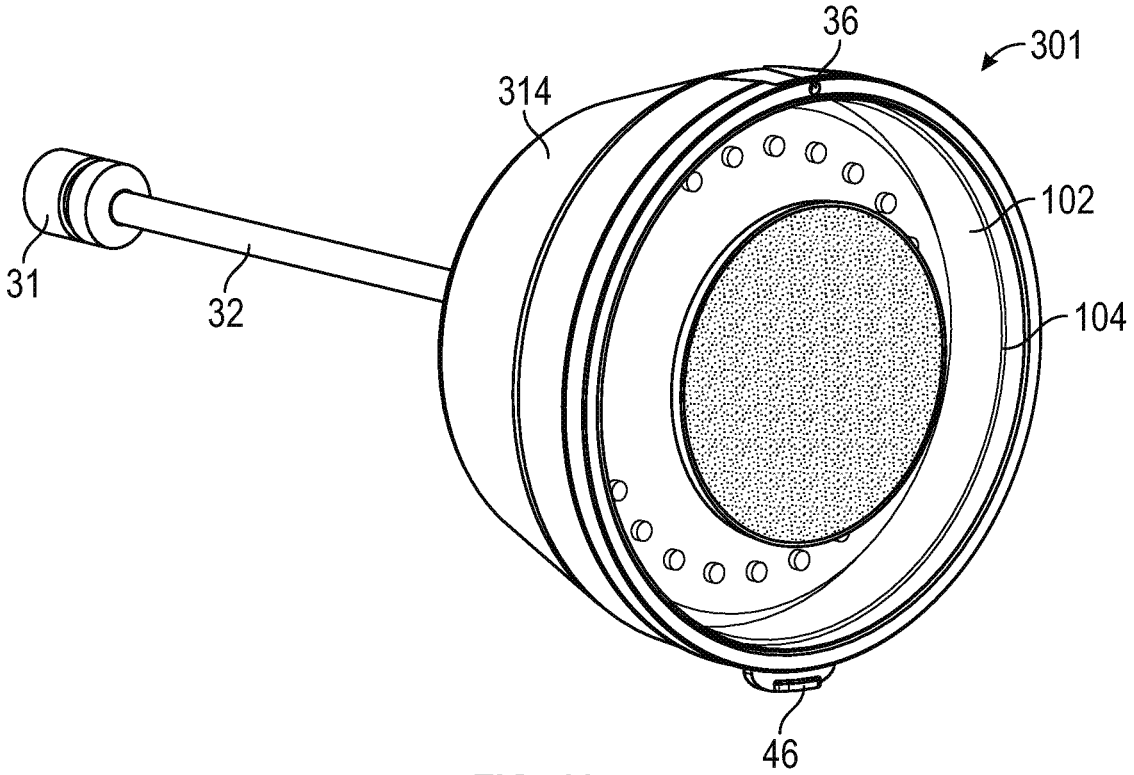
FIG. 41 is a front perspective view of the flangeless light system of FIG. 28 with additional detail showing an alternative embodiment for holding the light system within a niche box, similar to FIGS. 23A-D.

FIG. 41 is a front perspective view of the flangeless light system 301 of FIG. 28 with additional detail showing an alternative embodiment for holding the light system 301 within a niche box 90, similar to FIGS. 23A-D, which are schematic side perspective views of a manner for installing an embodiment of the invention in a niche box 90. In this embodiment, niche box is a cup-like structure having a hollow interior, an upper connecting means and a lower connecting means. The upper connecting means can be a screw hole 36 and the lower connecting means can be a slot 92 for accepting a tab 46. The light system 301 can be attached to the niche box 90 by holding the light system 301 at an angle, a tab 46 or tongue on the light system 301 is inserted into the lower connecting means slot 92 of the niche box 90. Once the tab 46 or tongue is inserted in to the slot 92, the light system 301 is rotated towards the open end of the niche box 90 so as to cover the opening in a manner similar to that shown in FIG. 23D. Once in place covering the opening of the niche box 90, a screw can be inserted through the screw hole 36 in the flange 33 and into the upper connecting means screw hole 36 of the niche box 90, thus securing the light system 301 to the niche box 90.

General Embodiments

The light systems described herein may be used on almost any artificial water body. While the light system is described in connection with a pool and spa, it is understood that the light system may be used on spas, swimming pools, tubs, jacuzzis, and the like. One of ordinary skill in the art can modify the light system without undue experimentation so that it can be placed on almost any artificial water body. Thus, the invention may be installed on pool or spa walls or shells to provide for the addition of aesthetically pleasing, decorative, architectural, and/or safety light to a pool or spa or the area surrounding a pool or spa.

The various components of the invention can be manufactured from relatively inexpensive materials. Appropriate components are molded or formed from a plastic material that will not corrode or be adversely affected from the exposure to water, particularly chlorinated water, and other chemicals present in a spa setting. Other appropriate components are formed from materials such as steel, aluminum, other metals, rock, acrylic, fiberglass, etc. as aesthetically or structurally needed or desired. Such materials are known in the art.

The foregoing detailed description of the preferred embodiments and the appended figures have been presented only for illustrative and descriptive purposes and are not intended to be exhaustive or to limit the scope and spirit of the invention. The embodiments were selected and described to best explain the principles of the invention and its practical applications. One of ordinary skill in the art will recognize that many variations can be made to the invention disclosed in this specification without departing from the scope and spirit of the invention.

While detailed descriptions of the preferred embodiments are provided herein, as well as the best mode of carrying out and employing the present invention, it is to be understood that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure, or manner.

What is claimed is:

1. A light system comprising:

a base component having a hollow body, a front end, and a back end;

a lens located at the front end of the body, the lens comprising a central area and a peripheral area surrounding the central area;

a mounting surface;

a means for securing the light system to the mounting surface;

a light source contained within the base component, wherein at least a portion of the light emanating from the light source passes into the lens; and a first means for modifying light emanating from the light source and passing through at least the central area of the lens, wherein the means for modifying light emanating from the light source comprises a first material placed within or on the central area of the lens, wherein the mounting surface includes a second material, and wherein the first material is selected from the group consisting of materials that match, complement, or contrast with the second material.

2. The light system as claimed in claim 1, wherein the first material is identical to the second material.

3. The light system as claimed in claim 1, wherein the central area of the lens and the peripheral area of the lens surrounding the central area of the lens are arranged in a concentric pattern such that light emanating from the light source is blocked or altered at at least a portion of the central area of the lens, and light emanating from the light source passes through the peripheral area of the lens, whereby light passing through the lens is seen through the peripheral area of the lens.

4. The light system as claimed in claim 1, further comprising a flange surrounding the peripheral area, wherein:

the flange is an extension of the base component;

the lens comprises the central area and the peripheral area surrounding the central area;

the lens is mounted on the front end of the base component within the flange; and the flange surrounds the peripheral area.

5. The light system of claim 1, wherein the base component and the lens are connected together in a waterproof or water-resistant manner.

6. The light system of claim 1, wherein the mounting surface is a wall of a pool or spa.

7. The light system of claim 1, wherein the mounting surface is a shell or liner of a pool or spa.

8. The light system of claim 1, further comprising a connector for releasably connecting the light system to an electrical system for providing power to the light system.

9. The light system as claimed in claim 1, wherein the central area of the lens includes a recess and wherein the first material is placed at least partially within the recess in the lens.

10. The light system as claimed in claim 9, wherein the first material is a cap that is placed at least partially within the recess in the lens.

11. The light system of claim 1, wherein the mounting surface is a light housing or niche box.

12. The light system of claim 11, wherein the means for securing the light system to the mounting surface comprises a tab and groove element.

13. A light system comprising:

a base component having a hollow body, a front end, and a back end;

a lens located at the front end of the body, the lens comprising a central area and a peripheral area surrounding the central area, wherein the central area of the lens is a first recess in the lens;

a mounting surface;

a means for securing the light system to the mounting surface;

a light source contained within the base component, wherein at least a portion of the light emanating from the light source passes into the lens; and a means for modifying light emanating from the light source and passing through at least the central area of the lens, wherein the means for modifying light emanating from the light source comprises a first material placed within or on the central area of the lens, wherein the mounting surface includes a second material, and wherein the first material is selected from the group consisting of materials that match, complement, or contrast with the second material.

14. The light system as claimed in claim 13, wherein the means for modifying light prevents a portion of the light from entering at least the central area of the lens, or alters a portion of the light passing through at least the central area of the lens.

15. The light system as claimed in claim 13, wherein the central area of the lens and the peripheral area of the lens surrounding the central area of the lens are arranged in a concentric pattern such that light emanating from the light source is blocked or altered at at least a portion of the central area of the lens and light emanating from the light source passes through the peripheral area of the lens, whereby light passing through the lens is seen through the peripheral area of the lens.

16. The light system as claimed in claim 15, further comprising a flange surrounding the peripheral area, wherein the flange comprises a second recess, wherein the flange is an extension of the lens, wherein the lens comprises the central area, the peripheral area surrounding the central area, and the flange surrounding the peripheral area.

17. The light system of claim 13, wherein the mounting surface is selected from the group consisting of a light housing, a niche box, a wall of a pool or spa, and a shell or liner of a pool or spa.

18. The light system of claim 17, wherein the means for securing the light system to the mounting surface comprises a tab and groove element.

* * * * *